US010619895B1

(12) United States Patent
Vandermeulen

(10) Patent No.: US 10,619,895 B1
(45) Date of Patent: Apr. 14, 2020

(54) ROOFTOP LIQUID DESICCANT SYSTEMS AND METHODS

(71) Applicant: 7AC Technologies, Inc., Beverly, MA (US)

(72) Inventor: Peter F. Vandermeulen, Newburyport, MA (US)

(73) Assignee: 7AC Technologies, Inc., Beverly, MA (US)

( * ) Notice: Subject to any disclaimer, the term of this patent is extended or adjusted under 35 U.S.C. 154(b) by 0 days.

(21) Appl. No.: 16/399,165

(22) Filed: Apr. 30, 2019

Related U.S. Application Data

(62) Division of application No. 14/664,219, filed on Mar. 20, 2015, now Pat. No. 10,323,867.

(60) Provisional application No. 61/978,539, filed on Apr. 11, 2014, provisional application No. 61/968,333, filed on Mar. 20, 2014.

(51) Int. Cl.

| | |
|---|---|
| ***F25B 30/04*** | (2006.01) |
| ***F24F 3/14*** | (2006.01) |
| ***F24F 3/147*** | (2006.01) |
| *F25B 25/00* | (2006.01) |
| *F24F 11/65* | (2018.01) |
| *F25B 29/00* | (2006.01) |

(52) U.S. Cl.
CPC ..... *F25B 30/04* (2013.01); *F24F 3/147* (2013.01); *F24F 3/1417* (2013.01); *F24F 11/65* (2018.01); *F24F 2003/1435* (2013.01); *F24F 2003/1452* (2013.01); *F24F 2003/1458* (2013.01); *F24F 2221/54* (2013.01); *F25B 25/005* (2013.01); *F25B 29/006* (2013.01)

(58) Field of Classification Search
CPC ..... F24F 3/1417; F24F 3/147; F24F 11/65; F24F 2003/1435; F24F 2003/1452; F24F 2003/1458; F24F 2221/54; F25B 30/04; F25B 25/005; F25B 29/006
See application file for complete search history.

(56) References Cited

U.S. PATENT DOCUMENTS 1,791,086 A 2/1931 Sperr
2,221,787 A 11/1940 Downs et al.
(Continued)

FOREIGN PATENT DOCUMENTS

CN 100366981 C 2/2008
CN 101336358 A 12/2008
(Continued)

OTHER PUBLICATIONS

1—Open Absorption System for Cooling and Air Conditioning using Membrane Contactors—Annual Report 2005, Publication No. Publication 260097, Project: 101310—Open Absorption System for Cooling and Air Conditioning using Membrane Contactors, Date of publication: Jan. 31, 2006, Author: Manuel Conde-Petit, Robert Weber, Contractor: M. Conde Engineering.
(Continued)

*Primary Examiner* — Frantz F Jules
*Assistant Examiner* — Martha Tadesse
(74) *Attorney, Agent, or Firm* — Foley Hoag LLP; Rajesh Vallabh

(57) ABSTRACT

Liquid desiccant air-conditioning systems cool and dehumidify a space in a building when operating in a cooling operation mode, and heat and humidify the space when operating in a heating operation mode.

21 Claims, 18 Drawing Sheets

(56) References Cited

U.S. PATENT DOCUMENTS 2,235,322 A 3/1941 Martin
2,433,741 A 12/1947 Crawford
2,634,958 A 4/1953 Simpelaar
2,660,159 A 11/1953 Hughes
2,708,915 A 5/1955 Mandelburg
2,939,686 A 6/1960 Wildermuth
2,988,171 A 6/1961 Arnold et al.
3,119,446 A 1/1964 Gerhart
3,193,001 A 7/1965 Meckler
3,276,634 A 10/1966 Arnot
3,409,969 A 11/1968 Simons
3,410,581 A 11/1968 Christensen
3,455,338 A 7/1969 Pollit
3,718,181 A 2/1973 Reilly et al.
4,100,331 A 7/1978 Fletcher et al.
4,164,125 A * 8/1979 Griffiths ..... F24F 3/1417 62/79
4,176,523 A 12/1979 Rousseau
4,205,529 A 6/1980 Ko
4,209,368 A 6/1980 Coker et al.
4,222,244 A 9/1980 Meckler
4,235,221 A 11/1980 Murphy
4,239,507 A 12/1980 Benoit et al.
4,259,849 A 4/1981 Griffiths
4,324,947 A 4/1982 Dumbeck
4,399,862 A 8/1983 Hile
4,429,545 A 2/1984 Steinberg
4,435,339 A 3/1984 Kragh
4,444,992 A 4/1984 Cox, III
4,583,996 A 4/1986 Sakata et al.
4,607,132 A 8/1986 Jarnagin
4,612,019 A 9/1986 Langhorst
4,649,899 A 3/1987 Moore
4,660,390 A 4/1987 Worthington
4,691,530 A 9/1987 Meckler
4,703,629 A 11/1987 Moore
4,730,600 A 3/1988 Harrigill
4,744,414 A 5/1988 Schon
4,766,952 A 8/1988 Onodera
4,786,301 A 11/1988 Rhodes
4,832,115 A 5/1989 Albers et al.
4,872,578 A 10/1989 Fuerschbach et al.
4,882,907 A 11/1989 Brown, II
4,887,438 A 12/1989 Meckler
4,900,448 A 2/1990 Bonne et al.
4,910,971 A 3/1990 McNab
4,939,906 A 7/1990 Spatz et al.
4,941,324 A 7/1990 Peterson et al.
4,955,205 A 9/1990 Wilkinson
4,971,142 A 11/1990 Mergler
4,976,313 A 12/1990 Dahlgren et al.
4,979,965 A 12/1990 Sannholm
4,984,434 A 1/1991 Peterson et al.
4,987,750 A 1/1991 Meckler
5,005,371 A 4/1991 Yonezawa et al.
5,181,387 A 1/1993 Meckler
5,182,921 A 2/1993 Yan
5,186,903 A 2/1993 Cornwell
5,191,771 A 3/1993 Meckler
5,221,520 A 6/1993 Cornwell
5,351,497 A 10/1994 Lowenstein
5,361,828 A 11/1994 Lee et al.
5,375,429 A 12/1994 Tokizaki et al.
5,448,895 A 9/1995 Coellner et al.
5,462,113 A 10/1995 Wand
5,471,852 A 12/1995 Meckler
5,528,905 A 6/1996 Scarlatti
5,534,186 A 7/1996 Walker et al.
5,582,026 A 12/1996 Barto, Sr.
5,595,690 A 1/1997 Filburn et al.
5,605,628 A 2/1997 Davidson et al.
5,606,865 A 3/1997 Caron
5,638,900 A 6/1997 Lowenstein et al.
5,641,337 A 6/1997 Arrowsmith et al.
5,661,983 A 9/1997 Groten et al.
5,685,152 A 11/1997 Sterling
5,685,485 A 11/1997 Mock et al.
5,797,272 A 8/1998 James
5,816,065 A 10/1998 Maeda
5,832,993 A 11/1998 Ohata et al.
5,860,284 A 1/1999 Goland et al.
5,860,285 A 1/1999 Tulpule
5,928,808 A 7/1999 Eshraghi
5,933,702 A 8/1999 Goswami
5,950,442 A 9/1999 Maeda et al.
6,012,296 A 1/2000 Shah
6,018,954 A 2/2000 Assaf
6,035,657 A 3/2000 Dobak, III et al.
6,083,387 A 7/2000 LeBlanc et al.
6,103,969 A 8/2000 Bussey
6,131,649 A 10/2000 Pearl et al.
6,134,903 A 10/2000 Potnis et al.
6,138,470 A 10/2000 Potnis et al.
6,156,102 A 12/2000 Conrad et al.
6,171,374 B1 1/2001 Barton et al.
6,216,483 B1 4/2001 Potnis et al.
6,216,489 B1 4/2001 Potnis et al.
6,244,062 B1 6/2001 Prado
6,247,604 B1 6/2001 Taskis et al.
6,266,975 B1 7/2001 Assaf
6,417,423 B1 7/2002 Koper et al.
6,442,951 B1 * 9/2002 Maeda ..... F24F 3/1423 62/271
6,463,750 B2 10/2002 Assaf
6,487,872 B1 12/2002 Forkosh et al.
6,488,900 B1 12/2002 Call et al.
6,497,107 B2 12/2002 Maisotsenko et al.
6,497,749 B2 12/2002 Kesten et al.
6,502,807 B1 1/2003 Assaf et al.
6,514,321 B1 2/2003 Lehto et al.
6,539,731 B2 4/2003 Kesten et al.
6,546,746 B2 * 4/2003 Forkosh ..... B01D 53/263 62/264
6,557,365 B2 5/2003 Dinnage et al.
6,660,069 B2 12/2003 Sato et al.
6,684,649 B1 2/2004 Thompson
6,739,142 B2 5/2004 Korin
6,745,826 B2 6/2004 Lowenstein et al.
6,766,817 B2 7/2004 da Silva et al.
6,848,265 B2 2/2005 Lowenstein et al.
6,854,278 B2 2/2005 Maisotsenko et al.
6,854,279 B1 2/2005 Digiovanni et al.
6,918,404 B2 7/2005 Dias da Silva et al.
6,938,434 B1 9/2005 Fair
6,945,065 B2 9/2005 Lee et al.
6,976,365 B2 12/2005 Forkosh et al.
6,986,428 B2 1/2006 Hester et al.
7,066,586 B2 6/2006 da Silva et al.
RE39,288 E * 9/2006 Assaf ..... F24F 3/1411 62/271
7,143,597 B2 12/2006 Hyland et al.
7,191,821 B2 3/2007 Gronwall et al.
7,197,887 B2 4/2007 Maisotsenko et al.
7,228,891 B2 6/2007 Shin et al.
7,258,923 B2 8/2007 van den Bogerd et al.
7,269,966 B2 9/2007 Lowenstein et al.
7,279,215 B2 10/2007 Hester et al.
7,306,650 B2 12/2007 Slayzak et al.
7,337,615 B2 3/2008 Reidy
7,430,878 B2 10/2008 Assaf
7,758,671 B2 7/2010 Kesten et al.
7,930,896 B2 4/2011 Matsui et al.
7,938,888 B2 5/2011 Assaf
8,141,379 B2 3/2012 Al-Hadhrami et al.
8,337,590 B2 12/2012 Herencia et al.
8,353,175 B2 1/2013 Wohlert
8,496,732 B2 7/2013 Culp et al.
8,499,576 B2 8/2013 Meijer
8,500,960 B2 8/2013 Ehrenberg et al.
8,623,210 B2 1/2014 Manabe et al.
8,641,806 B2 2/2014 Claridge et al.
8,648,209 B1 2/2014 Lastella
8,695,363 B2 4/2014 Tang et al.
8,696,805 B2 4/2014 Chang et al.

(56) References Cited

U.S. PATENT DOCUMENTS 8,769,971 B2 7/2014 Kozubal et al.
8,790,454 B2 7/2014 Lee et al.
8,800,308 B2 8/2014 Vandermeulen et al.
8,876,943 B2 11/2014 Gottlieb et al.
8,881,806 B2 11/2014 Xie et al.
8,943,844 B2 * 2/2015 Forkosh ..... B01D 53/263 62/94
8,943,850 B2 2/2015 Vandermeulen et al.
8,968,945 B2 3/2015 Fasold et al.
9,000,289 B2 4/2015 Vandermeulen et al.
9,086,223 B2 7/2015 Vandermeulen et al.
9,101,874 B2 8/2015 Vandermeulen
9,101,875 B2 8/2015 Vandermeulen et al.
9,243,810 B2 1/2016 Vandermeulen et al.
9,273,877 B2 3/2016 Vandermeulen et al.
9,308,490 B2 4/2016 Vandermeulen et al.
9,377,207 B2 6/2016 Vandermeulen et al.
9,429,332 B2 8/2016 Vandermeulen et al.
9,470,426 B2 10/2016 Vandermeulen
9,506,697 B2 11/2016 Vandermeulen
9,631,823 B2 4/2017 Vandermeulen et al.
9,631,848 B2 4/2017 Vandermeulen et al.
9,709,285 B2 7/2017 Vandermeulen
9,709,286 B2 7/2017 Vandermeulen et al.
9,835,340 B2 12/2017 Vandermeulen et al.
10,006,648 B2 6/2018 Vandermeulen et al.
10,024,558 B2 7/2018 Vandermeulen
10,024,601 B2 7/2018 Vandermeulen
10,168,056 B2 1/2019 Vandermeulen
10,323,867 B2 6/2019 Vandermeulen
2001/0008148 A1 7/2001 Ito et al.
2001/0013226 A1 8/2001 Potnis et al.
2001/0015500 A1 8/2001 Shimanuki et al.
2002/0023740 A1 2/2002 Lowenstein et al.
2002/0026797 A1 3/2002 Sundhar
2002/0038552 A1 4/2002 Maisotsenko et al.
2002/0098395 A1 7/2002 Shimanuki et al.
2002/0104439 A1 8/2002 Komkova et al.
2002/0139245 A1 10/2002 Kesten et al.
2002/0139320 A1 10/2002 Shimanuki et al.
2002/0148602 A1 10/2002 Nakamura
2003/0000230 A1 1/2003 Kopko
2003/0029185 A1 2/2003 Kopko
2003/0033821 A1 2/2003 Maisotsenko et al.
2003/0051498 A1 3/2003 Sanford
2003/0106680 A1 6/2003 Serpico et al.
2003/0121271 A1 7/2003 Dinnage et al.
2003/0230092 A1 12/2003 Lowenstein et al.
2004/0040697 A1 3/2004 Pierre et al.
2004/0061245 A1 4/2004 Maisotsenko et al.
2004/0101698 A1 5/2004 Yamanaka et al.
2004/0109798 A1 6/2004 Chopard et al.
2004/0112077 A1 * 6/2004 Forkosh ..... F24F 3/1417 62/271
2004/0118125 A1 6/2004 Potnis et al.
2004/0134212 A1 7/2004 Lee et al.
2004/0168462 A1 9/2004 Assaf
2004/0194944 A1 10/2004 Hendricks et al.
2004/0211207 A1 10/2004 Forkosh et al.
2004/0230092 A1 11/2004 Thierfelder et al.
2004/0231512 A1 11/2004 Slayzak et al.
2004/0261440 A1 12/2004 Forkosh et al.
2005/0095433 A1 5/2005 Bogerd et al.
2005/0106021 A1 5/2005 Bunker et al.
2005/0109052 A1 5/2005 Albers et al.
2005/0133082 A1 6/2005 Konold et al.
2005/0210907 A1 9/2005 Gillan et al.
2005/0217485 A1 10/2005 Olapinski et al.
2005/0218535 A1 10/2005 Maisotsenko et al.
2005/0257551 A1 11/2005 Landry
2006/0042295 A1 3/2006 Assaf
2006/0070728 A1 4/2006 Shin et al.
2006/0124287 A1 6/2006 Reinders
2006/0156750 A1 7/2006 Lowenstein et al.
2006/0156761 A1 7/2006 Mola et al.
2006/0278089 A1 12/2006 Theilow
2007/0169916 A1 7/2007 Wand et al.
2007/0175234 A1 8/2007 Pruitt
2007/0234743 A1 10/2007 Assaf
2008/0127965 A1 6/2008 Burton
2008/0156471 A1 7/2008 Han et al.
2008/0196758 A1 8/2008 McGuire
2008/0203866 A1 8/2008 Chamberlain
2008/0302357 A1 12/2008 DeNault
2008/0314567 A1 12/2008 Noren
2009/0000732 A1 1/2009 Jacobine et al.
2009/0056919 A1 3/2009 Hoffman et al.
2009/0095162 A1 4/2009 Hargis et al.
2009/0126913 A1 5/2009 Lee et al.
2009/0173096 A1 7/2009 Wohlert
2009/0183857 A1 7/2009 Pierce et al.
2009/0200022 A1 8/2009 Bravo et al.
2009/0238685 A1 9/2009 Santa Ana
2010/0000247 A1 1/2010 Bhatti et al.
2010/0012309 A1 1/2010 Uges
2010/0018322 A1 1/2010 Neitzke et al.
2010/0051083 A1 3/2010 Boyk
2010/0077783 A1 4/2010 Bhatti et al.
2010/0084120 A1 4/2010 Yin et al.
2010/0170776 A1 7/2010 Ehrenberg et al.
2010/0319370 A1 12/2010 Kozubal et al.
2011/0073290 A1 3/2011 Chang et al.
2011/0100618 A1 5/2011 Carlson
2011/0101117 A1 5/2011 Miyauchi et al.
2011/0126885 A1 6/2011 Kokotov et al.
2011/0132027 A1 6/2011 Gommed et al.
2012/0052785 A1 3/2012 Nagamatsu et al.
2012/0114527 A1 5/2012 Hoglund et al.
2012/0118148 A1 5/2012 Culp et al.
2012/0118155 A1 5/2012 Claridge et al.
2012/0125020 A1 5/2012 Vandermeulen et al.
2012/0125021 A1 5/2012 Vandermeulen et al.
2012/0125031 A1 5/2012 Vandermeulen et al.
2012/0125581 A1 5/2012 Allen et al.
2012/0131937 A1 5/2012 Vandermeulen et al.
2012/0131938 A1 5/2012 Vandermeulen et al.
2012/0131939 A1 5/2012 Vandermeulen et al.
2012/0132513 A1 * 5/2012 Vandermeulen ..... H01L 31/042 202/175
2012/0152318 A1 6/2012 Kee
2012/0186281 A1 7/2012 Vandermeulen et al.
2013/0056177 A1 3/2013 Coutu et al.
2013/0101909 A1 4/2013 Fasold et al.
2013/0186121 A1 7/2013 Erb et al.
2013/0199220 A1 8/2013 Ma et al.
2013/0227982 A1 * 9/2013 Forkosh ..... B01D 53/263 62/271
2013/0255287 A1 * 10/2013 Forkosh ..... F24F 3/1417 62/94
2013/0340449 A1 12/2013 Kozubal et al.
2014/0054004 A1 2/2014 LePoudre et al.
2014/0054013 A1 2/2014 LePoudre et al.
2014/0150481 A1 6/2014 Vandermeulen
2014/0150656 A1 6/2014 Vandermeulen
2014/0150657 A1 6/2014 Vandermeulen et al.
2014/0150662 A1 6/2014 Vandermeulen et al.
2014/0223947 A1 8/2014 Ranjan et al.
2014/0245769 A1 9/2014 Vandermeulen et al.
2014/0250935 A1 9/2014 Prochaska et al.
2014/0260367 A1 9/2014 Coutu et al.
2014/0260369 A1 9/2014 LePoudre
2014/0260371 A1 9/2014 Vandermeulen
2014/0260398 A1 9/2014 Kozubal et al.
2014/0260399 A1 9/2014 Vandermeulen
2014/0262125 A1 9/2014 Erb et al.
2014/0262144 A1 9/2014 Erb et al.
2014/0264968 A1 9/2014 Erb et al.
2014/0360373 A1 12/2014 Peacos et al.
2014/0366567 A1 12/2014 Vandermeulen
2015/0107287 A1 4/2015 Forkosh
2015/0184876 A1 7/2015 Vandermeulen et al.
2015/0300754 A1 10/2015 Vandermeulen et al.
2015/0323216 A1 11/2015 Wallin
2015/0338140 A1 11/2015 Vandermeulen

(56) References Cited

U.S. PATENT DOCUMENTS

| | | | |
|---|---|---|---|
| 2016/0187011 | A1 | 6/2016 | Vandermeulen |
| 2016/0290665 | A1 | 10/2016 | Vandermeulen et al. |
| 2017/0074530 | A1 | 3/2017 | Kozubal |
| 2017/0102155 | A1 | 4/2017 | Vandermeulen |
| 2017/0106639 | A1 | 4/2017 | Vandermeulen et al. |
| 2017/0167794 | A1 | 6/2017 | Vandermeulen |
| 2017/0184319 | A1 | 6/2017 | Vandermeulen et al. |
| 2017/0292722 | A1 | 10/2017 | Vandermeulen |
| 2018/0051897 | A1 | 2/2018 | Vandermeulen et al. |
| 2018/0163977 | A1 | 6/2018 | Vandermeulen |

FOREIGN PATENT DOCUMENTS

| | | | |
|---|---|---|---|
| CN | 100476308 | C | 4/2009 |
| CN | 101636630 | A | 1/2010 |
| CN | 102282426 | A | 12/2011 |
| CN | 202229469 | U | 5/2012 |
| EP | 0781972 | A2 | 7/1997 |
| EP | 1120609 | A1 | 8/2001 |
| EP | 1563229 | A1 | 8/2005 |
| EP | 1781995 | A1 | 5/2007 |
| EP | 2256434 | A2 | 12/2010 |
| EP | 2306100 | A1 | 4/2011 |
| EP | 2787293 | A1 | 10/2014 |
| GB | 1172247 | A | 11/1969 |
| JP | S54-77443 | A | 6/1979 |
| JP | S62-297647 | A | 12/1987 |
| JP | 02306067 | A | 12/1990 |
| JP | H03-125830 | A | 5/1991 |
| JP | H03-213921 | A | 9/1991 |
| JP | H08-105669 | A | 4/1996 |
| JP | H09-184692 | A | 7/1997 |
| JP | H10-220914 | A | 8/1998 |
| JP | H11-137948 | A | 5/1999 |
| JP | H11-197439 | A | 7/1999 |
| JP | H11-351700 | A | 12/1999 |
| JP | 2000-230730 | A | 8/2000 |
| JP | 2001-517773 | A | 10/2001 |
| JP | 2002-206834 | A | 7/2002 |
| JP | 2004-524504 | A | 8/2004 |
| JP | 2005-134060 | A | 5/2005 |
| JP | 2006-263508 | A | 10/2006 |
| JP | 2006-529022 | A | 12/2006 |
| JP | 2008-020138 | A | 1/2008 |
| JP | 2009-517622 | A | 4/2009 |
| JP | 2009-04273555 | B2 | 6/2009 |
| JP | 2009-180433 | A | 8/2009 |
| JP | 2009-192101 | A | 8/2009 |
| JP | 2009-281668 | A | 12/2009 |
| JP | 2009-293831 | A | 12/2009 |
| JP | 201054136 | A | 3/2010 |
| JP | 2010-247022 | A | 11/2010 |
| JP | 2011-064359 | A | 3/2011 |
| JP | 2011-511244 | A | 4/2011 |
| JP | 201192815 | A | 5/2011 |
| JP | 2011-163682 | A | 8/2011 |
| JP | 2012-073013 | A | 4/2012 |
| JP | 2013-064549 | A | 4/2013 |
| KR | 10-2001-0017939 | A | 3/2001 |
| KR | 2004-0026242 | A | 3/2004 |
| KR | 10-0510774 | B1 | 8/2005 |
| KR | 2014-0022785 | A | 2/2014 |
| TW | 201009269 | A | 3/2010 |
| WO | WO-1997021061 | A1 | 6/1997 |
| WO | WO-1999022180 | A1 | 5/1999 |
| WO | WO-2000011426 | A1 | 3/2000 |
| WO | WO-2000055546 | A1 | 9/2000 |
| WO | WO-2002066901 | A1 | 8/2002 |
| WO | WO-2002086391 | A1 | 10/2002 |
| WO | WO-2003004937 | A1 | 1/2003 |
| WO | WO-2004046618 | A1 | 6/2004 |
| WO | WO-2006006177 | A1 | 1/2006 |
| WO | WO-2008037079 | A1 | 4/2008 |
| WO | WO-2009094032 | A1 | 7/2009 |
| WO | WO-2009144880 | A1 | 12/2009 |
| WO | WO-2009157277 | A1 | 12/2009 |
| WO | WO-2011062808 | A1 | 5/2011 |
| WO | WO-2011161547 | A2 | 12/2011 |
| WO | WO-2012071036 | A1 | 5/2012 |
| WO | WO-2012082093 | A1 | 6/2012 |
| WO | WO-2013172789 | A1 | 11/2013 |

OTHER PUBLICATIONS

2—Open Absorption System for Cooling and Air Conditioning using Membrane Contactors—Annual, Report 2006, Publication No. Publication 260098, Project: 101310—Open Absorption System for Cooling and Air Conditioning using Membrane Contactors, Date of publication: Nov. 14, 2006, Author: Manuel Conde-Petit, Robert Weber, Contractor: M. Conde Engineering.

3—Open Absorption System for Cooling and Air Conditioning Using Membrane Contactors—Final Report, Publication No. Publication 280139, Project: 101310—Open Absorption System for Cooling and Air Conditioning using Membrane Contactors, Date of publication: Aug. 7, 2008, Author: Viktor Dorer, Manuel Conde-Petit, Robert Weber, Contractor: M. Conde Engineering.

4—Conde-Petit, M. 2007. Liquid Desiccant-Based Air-Conditioning Systems—LDACS, Proc. Of the 1st European Conference on Polygeneration—Technologies and Applications, 217-234, A. Coronas, ed., Tarragona—Spain, Oct. 16-17, Published by CREVER—Universitat Rovira I Virgili, Tarragona, Spain.

5—Conde-Petit, M. 2008. Open Absorption Systems for Air-Conditioning using Membrane Contactors,Proceedings '15. Schweizerisches Status—Seminar «Energie- and Umweltforschung im Bauwesen»', Sep. 11-12—ETH Zurich, Switzerland. Published by BRENET—Eggwilstr. 16a, CH-9552 Bronschhofen-Switzerland (brenet@vogel-tech.ch).

6—Third Party Observations for PCT/US2011/037936, dated Sep. 24, 2012.

Ashrae, et al., "Desiccant Dehumidification and Pressue Drying Equipment," 2012 ASHRAE Handbook—HVAC Systems and Equipment, Chapter 24, pp. 24.1-24.12.

Beccali, et al., "Energy and Economic Assessment of Desiccant Cooling," Solar Energy, Issue 83, pp. 1828-1846, Aug. 2009.

Fimbres-Weihs, et al., "Review of 3D CFD modeling of flow and mass transfer in narrow spacer-filled channels in membrane modules," Chemical Engineering and Processing 49 (2010) pp. 759-781.

Lachner, "An Investigation into the Feasibility of the Use of Water as a Refrigerant," International Refrigeration and Air Conditioning Conference, 723:1-9 (2004).

Li, F., et al., "Novel spacers for mass transfer enhancement in membrane separations," Journal of Membrane Science, 253 (2005), pp. 1-12.

Li, Y., et al., "CFD simulation of fluid flow through spacer-filled membrane module: selecting suitable cell types for periodic boundary conditions," Desalination 233 (2008) pp. 351-358.

Liu, et al., "Research Progress in Liquid Desiccant Air Conditioning Devices and Systems," Frontiers of Energy and Power Engineering in China, vol. 4, Issue 1, pp. 55-65, Feb. 2010.

Lowenstein, "A Solar Liquid-Desiccant Air Conditioner," Solar 2003, Proceedings of the 32nd ASES Annual Conference, Austin, TX, Jul. 2003.

Mathioulakis, "Desalination by Using Alternative Energy," Desalination, Issue 203, pp. 346-365, 2007.

Perry "Perry's Chemical Engineers handbook" 1999 McGraw Hill p. 11-52,11-53.

Refrigerant—Random House Kernerman Webster's College Dictionary, "Refrigerant," Random House, <https://thefreedictionary.com/refrigerant> (2010).

Siphon—Encyclopedia Americana. "Siphon." Grolier Online, 2015. Web. Apr. 3, 2015. 1 page.

Russell, et al., "Optimization of Photovolatic Thermal Collector Heat Pump Systems," ISES International Solar Energy Conference, Atlanta, GA, vol. 3, pp. 1870-1874, May 1979.

Welty, "Liquid Desiccant Dehumidification," Engineered Systems, May 2010, vol. 27 Issue 5, p. 34.

(56) References Cited

OTHER PUBLICATIONS

International Search Report and Written Opinion for PCT/US2015/021768, dated Sep. 30, 2015.
Extended European Search Report for Application No. EP15764538 dated Oct. 30, 2017.

* cited by examiner

Cooling Mode

Heating Mode

Cooling Mode

Heating Mode

ROOFTOP LIQUID DESICCANT SYSTEMS AND METHODS

RELATED APPLICATIONS

This application is a divisional of U.S. patent application Ser. No. 14/664,219, filed on Mar. 20, 2015 entitled ROOFTOP LIQUID DESICCANT SYSTEMS AND METHODS, which claims priority from U.S. Provisional Patent Application No. 61/968,333 filed on Mar. 20, 2014 entitled METHODS AND SYSTEMS FOR LIQUID DESICCANT ROOFTOP UNIT, and from U.S. Provisional Patent Application No. 61/978,539 filed on Apr. 11, 2014 entitled METHODS AND SYSTEMS FOR LIQUID DESICCANT ROOFTOP UNIT, all of which are hereby incorporated by reference.

BACKGROUND

The present application relates generally to the use of liquid desiccant membrane modules to dehumidify and cool an outside air stream entering a space. More specifically, the application relates to the use of micro-porous membranes to keep separate a liquid desiccant that is treating an outside air stream from direct contact with that air stream while in parallel using a conventional vapor compression system to treat a return air stream. The membrane allows for the use of turbulent air streams wherein the fluid streams (air, optional cooling fluids, and liquid desiccants) are made to flow so that high heat and moisture transfer rates between the fluids can occur. The application further relates to combining cost reduced conventional vapor compression technology with a more costly membrane liquid desiccant and thereby creating a new system at approximately equal cost but with much lower energy consumption.

Liquid desiccants have been used in parallel with conventional vapor compression HVAC (heating, ventilation, and air conditioning) equipment to help reduce humidity in spaces, particularly in spaces that either require large amounts of outdoor air or that have large humidity loads inside the building space itself. Humid climates, such as for example Miami, Fla. require a large amount of energy to properly treat (dehumidify and cool) the fresh air that is required for a space's occupant comfort. Conventional vapor compression systems have only a limited ability to dehumidify and tend to overcool the air, oftentimes requiring energy intensive reheat systems, which significantly increase the overall energy costs because reheat adds an additional heat-load to the cooling coil. Liquid desiccant systems have been used for many years and are generally quite efficient at removing moisture from the air stream. However, liquid desiccant systems generally use concentrated salt solutions such as solutions of LiCl, LiBr or CaCl2 and water. Such brines are strongly corrosive, even in small quantities so numerous attempt have been made over the years to prevent desiccant carry-over to the air stream that is to be treated. One approach—generally categorized as closed desiccant systems—is commonly used in equipment dubbed absorption chillers, places the brine in a vacuum vessel which then contains the desiccant and since the air is not directly exposed to the desiccant; such systems do not have any risk of carry-over of desiccant particles to the supply air stream. Absorption chillers however tend to be expensive both in terms of first cost and maintenance costs. Open desiccant systems allow a direct contact between the air stream and the desiccant, generally by flowing the desiccant over a packed bed similar to those used in cooling towers and evaporators. Such packed bed systems suffer from other disadvantages besides still having a carry-over risk: the high resistance of the packed bed to the air stream results in larger fan power and pressure drops across the packed bed, thus requiring more energy. Furthermore, the dehumidification process is adiabatic, since the heat of condensation that is released during the absorption of water vapor into the desiccant has no place to go. As a result both the desiccant and the air stream are heated by the release of the heat of condensation. This results in a warm, dry air stream where a cool dry air stream was desired, necessitating the need for a post-dehumidification cooling coil. Warmer desiccant is also exponentially less effective at absorbing water vapor, which forces the system to supply much larger quantities of desiccant to the packed bed which in turn requires larger desiccant pump power, since the desiccant is doing double duty as a desiccant as well as a heat transfer fluid. But the larger desiccant flooding rate also results in an increased risk of desiccant carryover. Generally air flow rates need to be kept well below the turbulent region (at Reynolds numbers of less than ~2,400) to prevent carryover. Applying a micro-porous membrane to the surface of these open liquid desiccant systems has several advantages. First it prevents any desiccant from escaping (carrying-over) to the air stream and becoming a source of corrosion in the building. And second, the membrane allows for the use of turbulent air flows enhancing heat and moisture transfer, which in turn results in a smaller system since it can be build more compactly. The micro-porous membrane retains the desiccant typically by being hydrophobic to the desiccant solution and breakthrough of desiccant can occur but only at pressures significantly higher than the operating pressure. The water vapor in an air stream that is flowing over the membrane diffuses through the membrane into the underlying desiccant resulting in a drier air stream. If the desiccant is at the same time cooler than the air stream, a cooling function will occur as well, resulting in a simultaneous cooling and dehumidification effect.

U.S. Patent Application Publication No. 2012/0132513, and PCT Application No. PCT/US11/037936 by Vandermeulen et al. disclose several embodiments for plate structures for membrane dehumidification of air streams. U.S. Patent Application Publication Nos. 2014-0150662, 2014-0150657, 2014-0150656, and 2014-0150657, PCT Application No. PCT/US13/045161, and U.S. Patent Application Nos. 61/658,205, 61/729,139, 61/731,227, 61/736,213, 61/758,035, 61/789,357, 61/906,219, and 61/951,887 by Vandermeulen et. al. disclose several manufacturing methods and details for manufacturing membrane desiccant plates. Each of these patent applications is hereby incorporated by reference herein in its entirety.

Conventional Roof Top Units (RTUs), which are a common means of providing cooling, heating, and ventilation to a space are inexpensive systems that are manufactured in high volumes. However, these RTUs are only able to handle small quantities of outside air, since they are generally not very good at dehumidifying the air stream and their efficiency drops significantly at higher outside air percentages. Generally RTUs provide between 5 and 20% outside air, and specialty units such as Make Up Air (MAUs) or Dedicated Outside Air Systems (DOAS) exist that specialize in providing 100% outside air and they can do so much more efficiently. However, the cost of a MAU or DOAS is often well over $2,000 per ton of cooling capacity compared to less than $1,000 per ton of a RTU. In many applications RTUs are the only equipment utilized simply because of their lower initial cost since the owner of the building and the entity paying for the electricity are often different. But the use of RTUs often results in poor energy performance, high humidity and buildings that feel much too cold. Upgrading a building with LED lighting for example can possibly lead to humidity problems and the cold feeling is increased because the internal heat load from incandescent lighting which helps heat a building, largely disappears when LEDs are installed.

Furthermore, RTUs generally do not humidify in winter operation mode. In winter the large amount of heating that is applied to the air stream results in very dry building conditions which can also be uncomfortable. In some buildings humidifiers are installed in ductwork or integrated to the RTU to provide humidity to the space. However, the evaporation of water in the air significantly cools that air requiring additional heat to be applied and thus increases energy costs.

There thus remains a need for a system that provides cost efficient, manufacturable and thermally efficient methods and systems to capture moisture from an air stream, while simultaneously cooling such an air stream in a summer operating mode, while also heating and humidifying an air stream in a winter operating mode and while also reducing the risk of contaminating such an air stream with desiccant particles.

SUMMARY

Provided herein are methods and systems used for the efficient dehumidification of an air stream using liquid desiccants. In accordance with one or more embodiments the liquid desiccant runs down the face of a support plate as a falling film in a conditioner for treating an air stream. In accordance with one or more embodiments, the liquid desiccant is covered by a microporous membrane so that liquid desiccant is unable to enter the air stream, but water vapor in the air stream is able to be absorbed into the liquid desiccant. In accordance with one or more embodiments the liquid desiccant is directed over a plate structure containing a heat transfer fluid. In accordance with one or more embodiments the heat transfer fluid is thermally coupled to a liquid to refrigerant heat exchanger and is pumped by a liquid pump. In accordance with one or more embodiments the refrigerant in the heat exchanger is cold and picks up heat through the heat exchanger. In accordance with one or more embodiments the warmer refrigerant leaving the heat exchanger is directed to a refrigerant compressor. In accordance with one or more embodiments the compressor compresses the refrigerant and the exiting hot refrigerant is directed to another heat transfer fluid in a refrigerant heat exchanger. In accordance with one or more embodiments the heat exchanger heats the hot heat transfer fluid. In accordance with one or more embodiments the hot heat transfer fluid is directed to a liquid desiccant regenerator through a liquid pump. In accordance with one or more embodiments a liquid desiccant in a regenerator is directed over a plate structure containing the hot heat transfer fluid. In accordance with one or more embodiments the liquid desiccant in the regenerator runs down the face of a support plate as a falling film. In accordance with one or more embodiments, the liquid desiccant in the regenerator is also covered by a microporous membrane so that liquid desiccant is unable to enter the air stream, but water vapor in the air stream is able to be desorbed from the liquid desiccant. In accordance with one or more embodiments the liquid desiccant is transported from the conditioner to the regenerator and from the regenerator back to the conditioner. In one or more embodiments, the liquid desiccant is pumped by a pump. In one or more embodiments, the liquid desiccant is pumped through a heat exchanger between the conditioner and the regenerator. In accordance with one or more embodiments the air exiting the conditioner is directed to a second air stream. In accordance with one or more embodiments the second air stream is a return air stream from a space. In accordance with one or more embodiments a portion of said return air stream is exhausted from the system and the remaining air stream is mixed with the air stream from the conditioner. In one or more embodiments, the exhausted portion is between 5 and 25% of the return air stream. In one or more embodiments, the exhausted portion is directed to the regenerator. In one or more embodiments, the exhausted portion is mixed with an outside air stream before being directed to the regenerator. In accordance with one or more embodiments the mixed air stream between the return air and the conditioner air is directed through a cooling or evaporator coil. In one or more embodiments, the cooling coil receives cold refrigerant from a refrigeration circuit. In one or more embodiments, the cooled air is directed back to the space to be cooled. In accordance with one or more embodiments the cooling coil receives cold refrigerant from an expansion valve or similar device. In one or more embodiments, the expansion valve receives liquid refrigerant from a condenser coil. In one or more embodiments, the condenser coil receives hot refrigerant gas from a compressor system. In one or more embodiments, the condenser coil is cooled by an outside air stream. In one or more embodiments, the hot refrigerant gas from the compressor is first directed to the refrigerant to liquid heat exchanger from the regenerator. In one or more embodiments, multiple compressors are used. In one or more embodiments, separate compressors serve the liquid to refrigerant heat exchangers from the compressors serving the evaporator and condenser coils. In one or more embodiments, the compressors are variable speed compressors. In one or more embodiments, the air streams are moved by a fan or blower. In one or more embodiments, such fans are variable speed fans.

Provided herein are methods and systems used for the efficient humidification of an air stream using liquid desiccants. In accordance with one or more embodiments a liquid desiccant runs down the face of a support plate as a falling film in a conditioner for treating an air stream. In accordance with one or more embodiments, the liquid desiccant is covered by a microporous membrane so that liquid desiccant is unable to enter the air stream, but water vapor in the air stream is able to be absorbed into the liquid desiccant. In accordance with one or more embodiments the liquid desiccant is directed over a plate structure containing a heat transfer fluid. In accordance with one or more embodiments the heat transfer fluid is thermally coupled to a liquid to refrigerant heat exchanger and is pumped by a liquid pump. In accordance with one or more embodiments the refrigerant in the heat exchanger is hot and rejects heat to the conditioner and hence to the air stream passing through said conditioner. In accordance with one or more embodiments the air exiting the conditioner is directed to a second air stream. In accordance with one or more embodiments the second air stream is a return air stream from a space. In accordance with one or more embodiments a portion of said return air stream is exhausted from the system and the remaining air stream is mixed with the air stream from the conditioner. In one or more embodiments, the exhausted portion is between 5 and 25% of the return air stream. In one or more embodiments, the exhausted portion is directed to the regenerator. In one or more embodiments, the exhausted portion is mixed with an outside air stream before being directed to the regenerator. In accordance with one or more embodiments the mixed air stream between the return air and the conditioner air is directed through a condenser coil. In one or more embodiments, the condenser coil receives hot refrigerant from a refrigeration circuit. In one or more embodiments, the condenser coil warms the mixed air stream coming from the conditioner and the remaining return air from the space. In one or more embodiments, the warmer air is directed back to the space to be cooled. In accordance with one or more embodiments the condenser coil receives hot refrigerant from the liquid to refrigerant heat exchanger. In one or more embodiments, the condenser coil receives hot refrigerant gas from a compressor system directly. In one or more embodiments, the colder, liquid refrigerant leaving the condenser coil is directed to an expansion valve or similar device. In one or more embodiments, the refrigerant expands in the expansion valve and is directed to an evaporator coil. In one or more embodiments, the evaporator coil also receives an outside air stream from which it pulls heat to heat the cold refrigerant from the expansion valve. In one or more embodiments, the warmer refrigerant from the evaporator coil is directed to a liquid to refrigerant heat exchanger. In one or more embodiments, the liquid to refrigerant heat exchanger receives the refrigerant from the evaporator and absorbs additional heat from a heat transfer fluid loop. In one or more embodiments, the heat transfer fluid loop is thermally coupled to a regenerator. In one or more embodiments, the regenerator collects heat and moisture from an air stream. In accordance with one or more embodiments the liquid desiccant in the regenerator is directed over a plate structure containing the cold heat transfer fluid. In accordance with one or more embodiments the liquid desiccant in the regenerator runs down the face of a support plate as a falling film. In accordance with one or more embodiments, the liquid desiccant in the regenerator is also covered by a microporous membrane so that liquid desiccant is unable to enter the air stream, but water vapor in the air stream is able to be desorbed from the liquid desiccant. In one or more embodiments, the air stream is an air stream rejected from the return air stream. In one or more embodiments, the air stream is an outside air stream. In one or more embodiments, the air stream is a mixture of the rejected air stream and an outside air stream. In one or more embodiments, the refrigerant leaving the liquid to refrigerant heat exchanger is directed to a refrigerant compressor. In one or more embodiments, the compressor compresses the refrigerant which is then directed to a conditioner heat exchanger. In accordance with one or more embodiments the heat exchanger heats the hot heat transfer fluid. In accordance with one or more embodiments the hot heat transfer fluid is directed to the liquid desiccant conditioner through a liquid pump. In accordance with one or more embodiments the liquid desiccant is transported from the conditioner to the regenerator and from the regenerator back to the conditioner. In one or more embodiments, the liquid desiccant is pumped by a pump. In one or more embodiments, the liquid desiccant is pumped through a heat exchanger between the conditioner and the regenerator. In one or more embodiments, separate compressors serve the liquid to refrigerant heat exchangers from the compressors serving the evaporator and condenser coils. In one or more embodiments, the compressors are variable speed compressors. In one or more embodiments, the air streams are moved by a fan or blower. In one or more embodiments, such fans are variable speed fans. In one or more embodiments, multiple compressors are used. In accordance with one or more embodiments the cooler refrigerant leaving the heat exchanger is directed to a condenser coil. In accordance with one or more embodiments the condenser coil is receiving an air stream and the still hot refrigerant is used to heat such an air stream. In one or more embodiments, water is added to the desiccant during operation. In one or more embodiments, water is added during winter heating mode. In one or more embodiments, water is added to control the concentration of the desiccant. In one or more embodiments, water is added during dry hot weather.

Provided herein are methods and systems used for the efficient dehumidification of an air stream using liquid desiccants. In accordance with one or more embodiments the liquid desiccant runs down the face of a support plate as a falling film in a conditioner for treating an air stream. In accordance with one or more embodiments, the liquid desiccant is covered by a microporous membrane so that liquid desiccant is unable to enter the air stream, but water vapor in the air stream is able to be absorbed into the liquid desiccant. In accordance with one or more embodiments the liquid desiccant is thermally coupled to a desiccant to refrigerant heat exchanger and is pumped by a liquid pump. In accordance with one or more embodiments the refrigerant in the heat exchanger is cold and picks up heat through the heat exchanger. In accordance with one or more embodiments the warmer refrigerant leaving the heat exchanger is directed to a refrigerant compressor. In accordance with one or more embodiments the compressor compresses the refrigerant and the exiting hot refrigerant is directed to another refrigerant to desiccant heat exchanger. In accordance with one or more embodiments the heat exchanger heats a hot desiccant. In accordance with one or more embodiments the hot desiccant is directed to a liquid desiccant regenerator through a liquid pump. In accordance with one or more embodiments a liquid desiccant in a regenerator is directed over a plate structure. In accordance with one or more embodiments the liquid desiccant in the regenerator runs down the face of a support plate as a falling film. In accordance with one or more embodiments, the liquid desiccant in the regenerator is also covered by a microporous membrane so that liquid desiccant is unable to enter the air stream, but water vapor in the air stream is able to be desorbed from the liquid desiccant. In accordance with one or more embodiments the liquid desiccant is transported from the conditioner to the regenerator and from the regenerator back to the conditioner. In one or more embodiments, the liquid desiccant is pumped by a pump. In one or more embodiments, the liquid desiccant is pumped through a heat exchanger between the conditioner and the regenerator. In accordance with one or more embodiments the air exiting the conditioner is directed to a second air stream. In accordance with one or more embodiments the second air stream is a return air stream from a space. In accordance with one or more embodiments a portion of said return air stream is exhausted from the system and the remaining air stream is mixed with the air stream from the conditioner. In one or more embodiments, the exhausted portion is between 5 and 25% of the return air stream. In one or more embodiments, the exhausted portion is directed to the regenerator. In one or more embodiments, the exhausted portion is mixed with an outside air stream before being directed to the regenerator. In accordance with one or more embodiments the mixed air stream between the return air and the conditioner air is directed through a cooling or evaporator coil. In one or more embodiments, the cooling coil receives cold refrigerant from a refrigeration circuit. In one or more embodiments, the cooled air is directed back to the space to be cooled. In accordance with one or more embodiments the cooling coil receives cold refrigerant from an expansion valve or similar device. In one or more embodiments, the expansion valve receives liquid refrigerant from a condenser coil. In one or more embodiments, the condenser coil receives hot refrigerant gas from a compressor system. In one or more embodiments, the condenser coil is cooled by an outside air stream. In one or more embodiments, the hot refrigerant gas from the compressor is first directed to the refrigerant to desiccant heat exchanger from the regenerator. In one or more embodiments, multiple compressors are used. In one or more embodiments, separate compressors serve the desiccant to refrigerant heat exchangers from the compressors serving the evaporator and condenser coils. In one or more embodiments, the compressors are variable speed compressors. In one or more embodiments, the air streams are moved by a fan or blower. In one or more embodiments, such fans are variable speed fans. In one or more embodiments, the flow direction of the refrigerant is reversed for a winter heating mode. In one or more embodiments, water is added to the desiccant during operation. In one or more embodiments, water is added during winter heating mode. In one or more embodiments, water is added to control the concentration of the desiccant. In one or more embodiments, water is added during dry hot weather.

Provided herein are methods and systems used for the efficient dehumidification of an air stream using liquid desiccants. In accordance with one or more embodiments the liquid desiccant runs down the face of a support plate as a falling film in a conditioner for treating an air stream. In accordance with one or more embodiments, the liquid desiccant is covered by a microporous membrane so that liquid desiccant is unable to enter the air stream, but water vapor in the air stream is able to be absorbed into the liquid desiccant. In accordance with one or more embodiments the liquid desiccant is thermally coupled to a refrigerant heat exchanger embedded in the conditioner. In accordance with one or more embodiments the refrigerant in the conditioner is cold and picks up heat from the desiccant and hence from the air stream flowing through the conditioner. In accordance with one or more embodiments the warmer refrigerant leaving the conditioner is directed to a refrigerant compressor. In accordance with one or more embodiments the compressor compresses the refrigerant and the exiting hot refrigerant is directed to a regenerator. In accordance with one or more embodiments the hot refrigerant is embedded into a structure in the regenerator. In accordance with one or more embodiments a liquid desiccant in the regenerator is directed over a plate structure. In accordance with one or more embodiments the liquid desiccant in the regenerator runs down the face of a support plate as a falling film. In accordance with one or more embodiments, the liquid desiccant in the regenerator is also covered by a microporous membrane so that liquid desiccant is unable to enter the air stream, but water vapor in the air stream is able to be desorbed from the liquid desiccant. In accordance with one or more embodiments the liquid desiccant is transported from the conditioner to the regenerator and from the regenerator back to the conditioner. In one or more embodiments, the liquid desiccant is pumped by a pump. In one or more embodiments, the liquid desiccant is pumped through a heat exchanger between the conditioner and the regenerator. In accordance with one or more embodiments the air exiting the conditioner is directed to a second air stream. In accordance with one or more embodiments the second air stream is a return air stream from a space. In accordance with one or more embodiments a portion of said return air stream is exhausted from the system and the remaining air stream is mixed with the air stream from the conditioner. In one or more embodiments, the exhausted portion is between 5 and 25% of the return air stream. In one or more embodiments, the exhausted portion is directed to the regenerator. In one or more embodiments, the exhausted portion is mixed with an outside air stream before being directed to the regenerator. In accordance with one or more embodiments the mixed air stream between the return air and the conditioner air is directed through a cooling or evaporator coil. In one or more embodiments, the cooling coil receives cold refrigerant from a refrigeration circuit. In one or more embodiments, the cooled air is directed back to the space to be cooled. In accordance with one or more embodiments the cooling coil receives cold refrigerant from an expansion valve or similar device. In one or more embodiments, the expansion valve receives liquid refrigerant from a condenser coil. In one or more embodiments, the condenser coil receives hot refrigerant gas from a compressor system. In one or more embodiments, the condenser coil is cooled by an outside air stream. In one or more embodiments, the hot refrigerant gas from the compressor is first directed to the refrigerant to desiccant heat exchanger from the regenerator. In one or more embodiments, multiple compressors are used. In one or more embodiments, separate compressors serve the desiccant to refrigerant heat exchangers from the compressors serving the evaporator and condenser coils. In one or more embodiments, the compressors are variable speed compressors. In one or more embodiments, the air streams are moved by a fan or blower. In one or more embodiments, such fans are variable speed fans. In one or more embodiments, the flow direction of the refrigerant is reversed for a winter heating mode. In one or more embodiments, water is added to the desiccant during operation. In one or more embodiments, water is added during winter heating mode. In one or more embodiments, water is added to control the concentration of the desiccant. In one or more embodiments, water is added during dry hot weather.

Provided herein are methods and systems used for the efficient humidification of a desiccant stream using water and selective membranes. In accordance with one or more embodiments a set of pairs of channels for liquid transport are provided wherein the one side of the channel pair receives a water stream and the other side of the channel pair receives a liquid desiccant. In one or more embodiments, the water is tap water, sea water, waste water and the like. In one or more embodiments, the liquid desiccant is any liquid desiccant that is able to absorb water. In one or more embodiments, the elements of the channel pair are separated by a membrane selectively permeable to water but not to any other constituents. In one or more embodiments, the membrane is a reverse osmosis membrane, or some other convenient selective membrane. In one or more embodiments, multiple pairs can be individually controlled to vary the amount of water that is added to the desiccant stream from the water stream. In one or more embodiments, other driving forces besides concentration potential differences are used to assist the permeation of water through the membrane. In one or more embodiments, such driving forces are heat or pressure.

Provided herein are methods and systems used for the efficient humidification of a desiccant stream using water and selective membranes. In accordance with one or more embodiments, a water injector comprising a series of channel pairs is connected to a liquid desiccant circuit and a water circuit wherein one half of the channel pairs receives a liquid desiccant and the other half receives the water. In one or more embodiments, the channel pairs are separated by a selective membrane. In accordance with one or more embodiments the liquid desiccant circuit is connected between a regenerator and a conditioner. In one or more embodiments, the water circuit receives water from a water tank through a pumping system. In one or more embodiments, excess water that is not absorbed through the selective membrane is drained back to the water tank. In one or more embodiments, the water tank is kept full by a level sensor or float switch. In one or more embodiments, precipitates or concentrated water is drained from the water tank by a drain valve also known as a blow-down procedure.

Provided herein are methods and systems used for the efficient humidification of a desiccant stream using water and selective membranes while at the same time providing a heat transfer function between two desiccant streams. In accordance with one or more embodiments, a water injector comprising a series of channel triplets is connected to two liquid desiccant circuits and a water circuit wherein a third of the channel triplets receives a hot liquid desiccant, a second third of the triplets receives a cold liquid desiccant and the remaining third of the triplets receives the water. In one or more embodiments, the channel triplets are separated by a selective membrane. In accordance with one or more embodiments the liquid desiccant channels are connected between a regenerator and a conditioner. In one or more embodiments, the water circuit receives water from a water tank through a pumping system. In one or more embodiments, excess water that is not absorbed through the selective membrane is drained back to the water tank. In one or more embodiments, the water tank is kept full by a level sensor or float switch. In one or more embodiments, precipitates or concentrated water is drained from the water tank by a drain valve also known as a blow-down procedure.

Provided herein are methods and systems used for the efficient dehumidification or humidification of an air stream using liquid desiccants. In accordance with one or more embodiments a liquid desiccant stream is split into a larger and a smaller stream. In accordance with one or more embodiments, the larger stream is directed into a heat transfer channel that is constructed to provide fluid flow in a counter-flow direction to an air stream. In one or more embodiments, the larger stream is a horizontal fluid stream and the air stream is a horizontal stream in a direction counter to the fluid stream. In one or more embodiments, the larger stream is flowing vertically upward or vertically downward, and the air stream is flowing vertically downward or vertically upward in a counter-flow orientation. In one or more embodiments, the mass flow rates of the larger stream and the air flow stream are approximately equal within a factor of two. In one or more embodiments, the larger desiccant stream is directed to a heat exchanger coupled to a heating or cooling device. In one or more embodiments, the heat or cooling device is a heat pump, a geothermal source, a hot water source, and the like. In one or more embodiments, the heat pump is reversible. In one or more embodiments, the heat exchanger is made from a non-corrosive material. In one or more embodiments, the material is titanium or any suitable material non-corrosive to the desiccant. In one or more embodiments, the desiccant itself is non-corrosive. In one or more embodiments, the smaller desiccant stream is simultaneously directed to a channel that is flowing downward by gravity. In one or more embodiments, the smaller stream is bound by a membrane that has an air flow on the opposite side. In one or more embodiments, the membrane is a micro-porous membrane. In one or more embodiments, the mass flow rate of the smaller desiccant stream is between 1 and 10% of the mass flow rate of the larger desiccant stream. In one or more embodiments, the smaller desiccant stream is directed to a regenerator for removing excess water vapor after exiting the (membrane) channel.

Provided herein are methods and systems used for the efficient dehumidification or humidification of an air stream using liquid desiccants. In accordance with one or more embodiments a liquid desiccant stream is split into a larger and a smaller stream. In one or more embodiments, the larger stream is directed into a heat transfer channel that is constructed to provide fluid flow in a counter-flow direction to an air stream. In one or more embodiments, the smaller stream is directed to a membrane bound channel. In one or more embodiments, the membrane channel has an air stream on the opposite side of the desiccant. In one or more embodiments, the larger stream is directed to a heat pump heat exchanger after leaving the heat transfer channel and is directed back to the heat transfer channel after being cooled or heated by the heat pump heat exchanger. In one or more embodiments, the air stream is an outside air stream. In one or more embodiments, the air stream after being treated by the desiccant behind the membrane is directed into a larger air stream that is returning from a space. In one or more embodiments, the larger air stream is subsequently cooled by a coil that is coupled to the same heat pump refrigeration circuit as the heat exchanger heat pump. In one or more embodiments, the desiccant stream is a single desiccant stream and the heat transfer channel is configured as a two-way heat and mass exchanger module. In one or more embodiments, the two-way heat and mass exchanger module is bound by a membrane. In one or more embodiments, the membrane is a micro-porous membrane. In one or more embodiments, the two-way heat and mass exchanger module is treating an outside air stream. In one or more embodiments, the air stream after being treated by the desiccant behind the membrane is directed into a larger air stream that is returning from a space. In one or more embodiments, the larger air stream is subsequently cooled by a coil that is coupled to the same heat pump refrigeration circuit as the heat exchanger heat pump.

In no way is the description of the applications intended to limit the disclosure to these applications. Many construction variations can be envisioned to combine the various elements mentioned above each with its own advantages and disadvantages. The present disclosure in no way is limited to a particular set or combination of such elements.

DETAILED DESCRIPTION OF PREFERRED EMBODIMENTS

Figure 1:
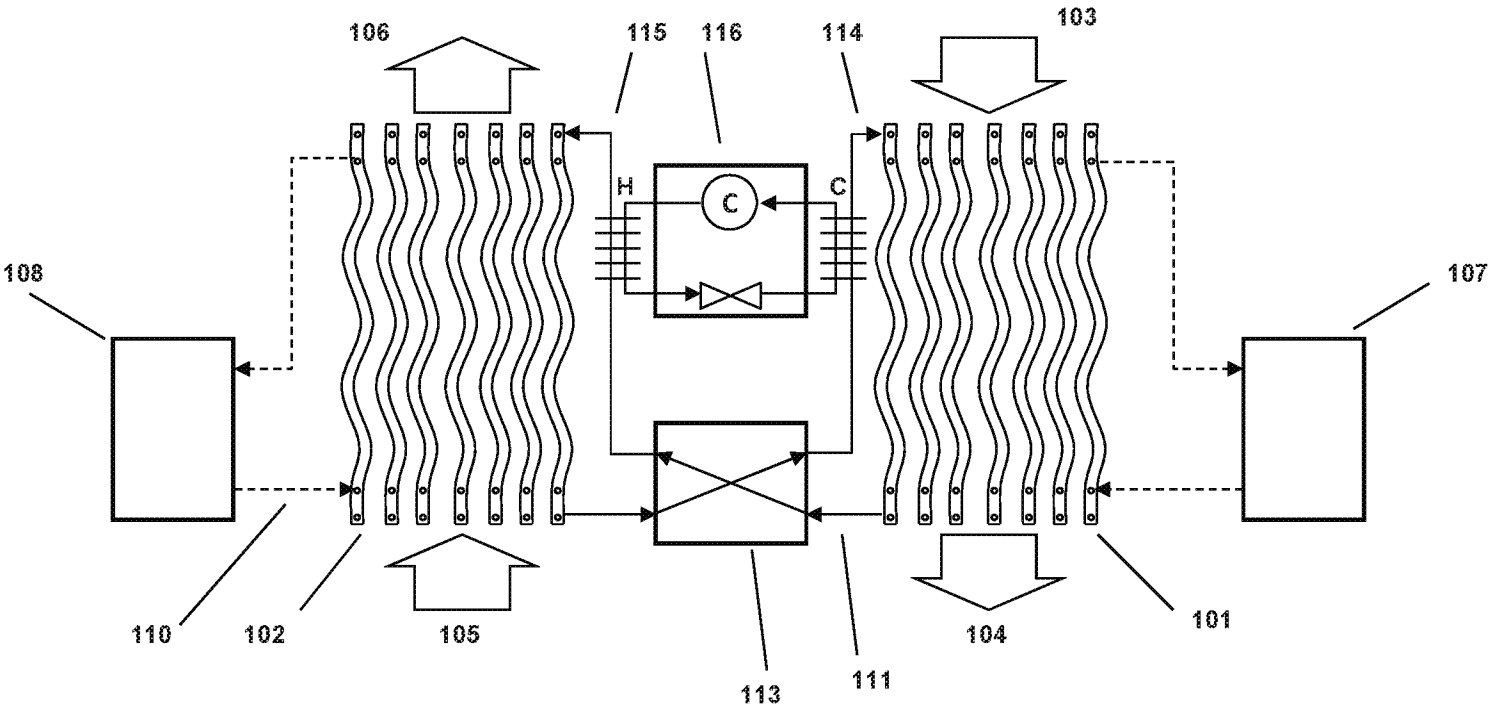
FIG. 1 illustrates an exemplary 3-way liquid desiccant air conditioning system using a chiller or external heating or cooling sources.

FIG. 1 depicts a new type of liquid desiccant system as described in more detail in U.S. Patent Application Publication No. 20120125020, which is incorporated by reference herein. A conditioner 101 comprises a set of plate structures that are internally hollow. A cold heat transfer fluid is generated in cold source 107 and entered into the plates. Liquid desiccant solution at 114 is brought onto the outer surface of the plates and runs down the outer surface of each of the plates. The liquid desiccant runs behind a thin sheet of material such as a membrane that is located between the air flow and the surface of the plates. The sheet of material can also comprise a hydrophilic material or a flocking material in which case the liquid desiccant runs more or less inside the material rather than over its surface. Outside air 103 is now blown through the set of plates. The liquid desiccant on the surface of the plates attracts the water vapor in the air flow and the cooling water inside the plates helps to inhibit the air temperature from rising. The treated air 104 is put into a building space. The liquid desiccant conditioner 101 and regenerator 102 are generally known as 3-way liquid desiccant heat and mass exchangers, because they exchange heat and mass between the air stream, the desiccant, and a heat transfer fluid, so that there are three fluid streams involved. Two-way heat and mass exchangers generally have only a liquid desiccant and an air stream involved as will be seen later.

The liquid desiccant is collected at the lower end of each plate at 111 without the need for either a collection pan or bath so that the air flow can be horizontal or vertical. Each of the plates may have a separate desiccant collector at a lower end of the outer surfaces of the plate for collecting liquid desiccant that has flowed across the surfaces. The desiccant collectors of adjacent plates are spaced apart from each other to permit airflow therebetween. The liquid desiccant is then transported through a heat exchanger 113 to the top of the regenerator 102 to point 115 where the liquid desiccant is distributed across the plates of the regenerator. Return air or optionally outside air 105 is blown across the regenerator plate and water vapor is transported from the liquid desiccant into the leaving air stream 106. An optional heat source 108 provides the driving force for the regeneration. The hot heat transfer fluid 110 from the heat source can be put inside the plates of the regenerator similar to the cold heat transfer fluid on the conditioner. Again, the liquid desiccant is collected at the bottom of the plates 102 without the need for either a collection pan or bath so that also on the regenerator the air flow can be horizontal or vertical. An optional heat pump 116 can be used to provide cooling and heating of the liquid desiccant, however it is generally more favorable to connect a heat pump between the cold source 107 and the hot source 108, which is thus pumping heat from the cooling fluids rather than from the desiccant.

Figure 2:
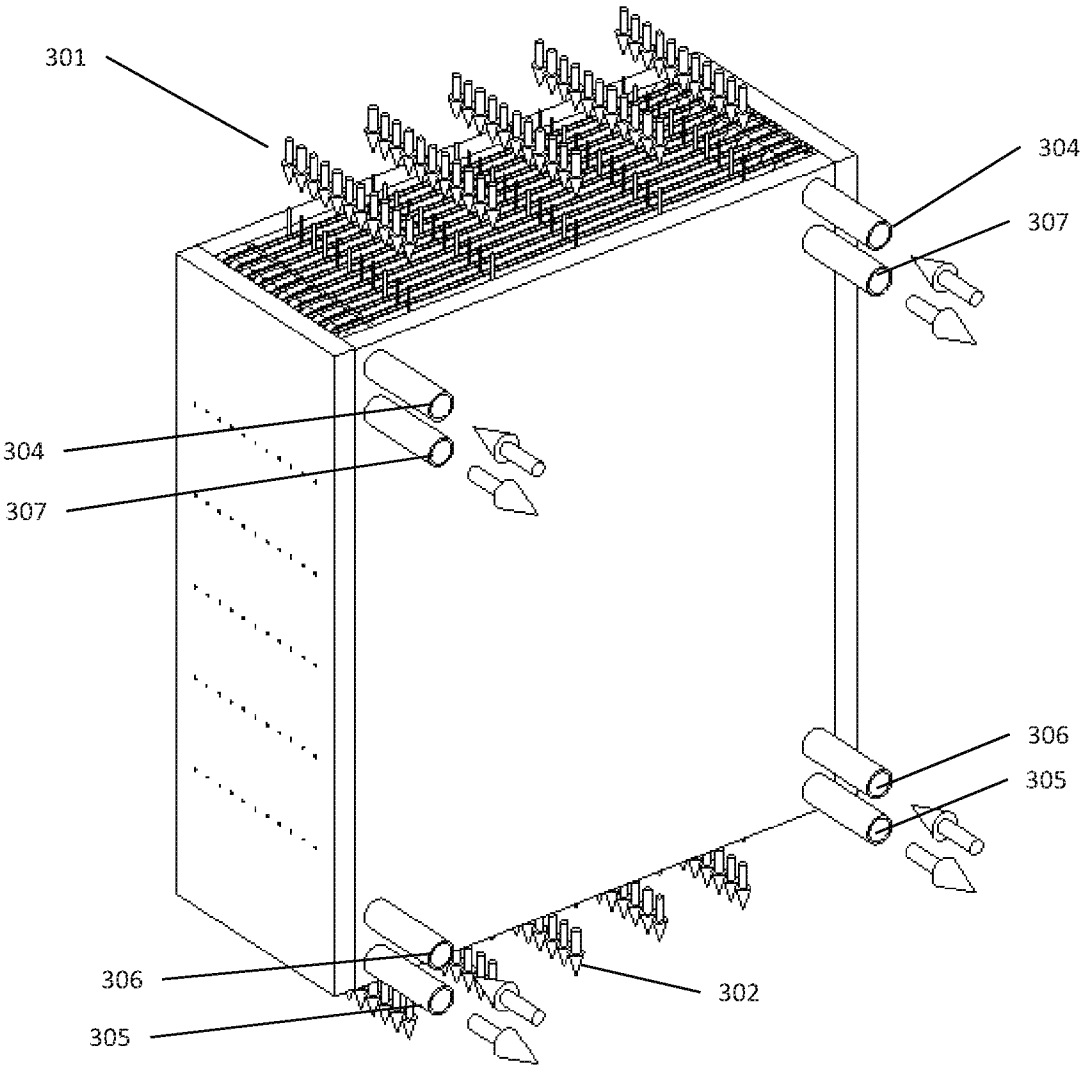
FIG. 2 shows an exemplary flexibly configurable membrane module that incorporates 3-way liquid desiccant plates.

FIG. 2 describes a 3-way heat and mass exchanger as described in further detail in U.S. Patent Application Publication Nos. 2014-0150662 filed on Jun. 11, 2013, 2014-0150656 filed on Jun. 11, 2013, and US 2014-0150657 filed on Jun. 11, 2013, which are all incorporated by reference herein. A liquid desiccant enters the structure through ports 304 and is directed behind a series of membranes as described in FIG. 1. The liquid desiccant is collected and removed through ports 305. A cooling or heating fluid is provided through ports 306 and runs counter to the air stream 301 inside the hollow plate structures, again as described in FIG. 1 and in more detail in FIG. 3. The cooling or heating fluids exit through ports 307. The treated air 302 is directed to a space in a building or is exhausted as the case may be.

Figure 3:
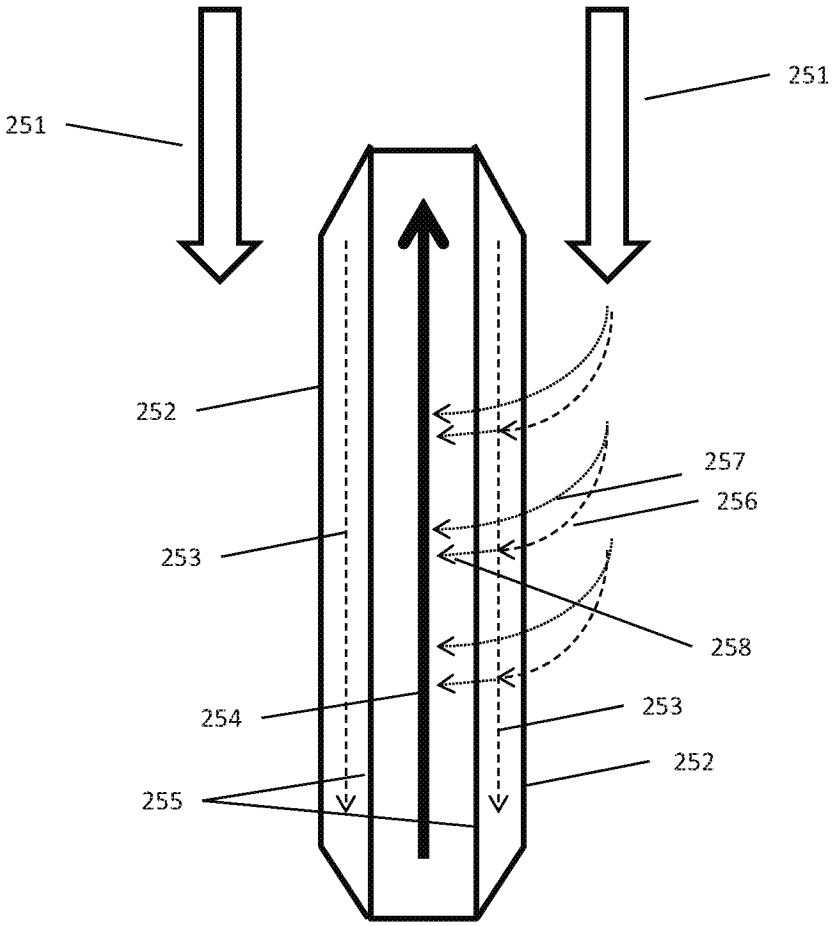
FIG. 3 illustrates an exemplary single membrane plate in the liquid desiccant membrane module of FIG. 2.

FIG. 3 describes a 3-way heat exchanger as described in more detail in U.S. Provisional Patent Application Ser. No. 61/771,340 filed on Mar. 1, 2013 and U.S. Patent Application Publication No. US 2014-0245769, which are incorporated by reference herein. The air stream 251 flows counter to a cooling fluid stream 254. Membranes 252 contain a liquid desiccant 253 that is falling along the wall 255 that contain a heat transfer fluid 254. Water vapor 256 entrained in the air stream is able to transition the membrane 252 and is absorbed into the liquid desiccant 253. The heat of condensation of water 258 that is released during the absorption is conducted through the wall 255 into the heat transfer fluid 254. Sensible heat 257 from the air stream is also conducted through the membrane 252, liquid desiccant 253 and wall 255 into the heat transfer fluid 254.

Figure 4A:
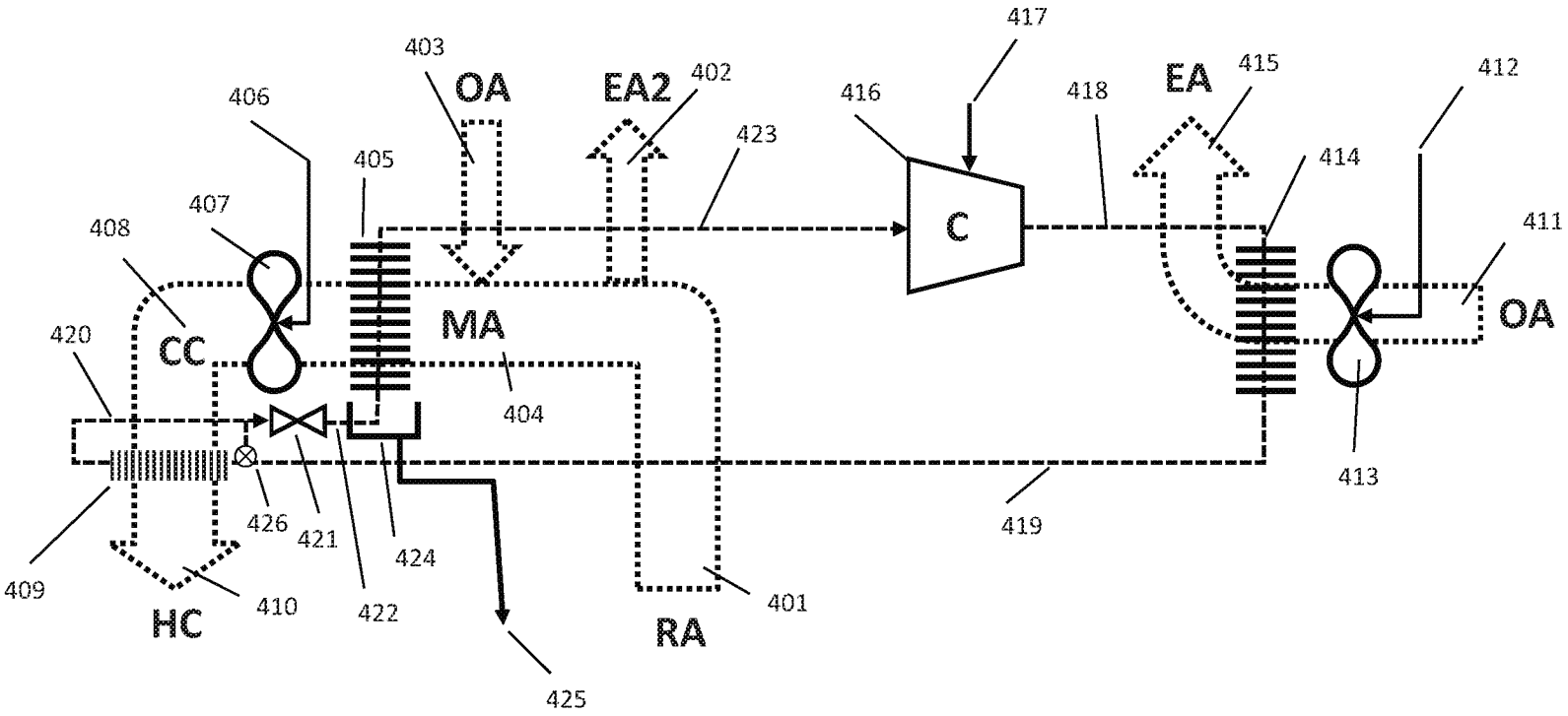
FIG. 4A schematically illustrates a conventional mini-split air conditioning system operating in a cooling mode.

FIG. 4A illustrates a schematic diagram of a conventional packaged Roof-Top Unit (RTU) air conditioning system as is frequently installed on buildings, operating in a cooling mode. The unit comprises a set of components that generate cool, dehumidified air and a set of components that release heat to the environment. In a packaged unit, the cooling and heating components are generally inside a single enclosure. It is however possible to separate the cooling and heating components into separate enclosures or locate them in separate locations. The cooling components comprise a cooling (evaporator) coil 405 through which a fan 407 pulls return air (labeled RA) 401 that has been returned (usually through a duct work—which is not shown) from a space. Prior to reaching the cooling coil 405, some of the return air RA is exhausted from the system as exhaust air EA2 402, which is replaced by outside air OA 403 which is mixed with the remaining return air to a mixed air stream MA 404. In summer, this outside air OA is often warm and humid and adds a significant contribution to the cooling load on the system. The cooling coil 405 cools the air and condenses water vapor on the coil which is collected in drain pan 424 and ducted to the outside 425. The resulting cooler, drier air CC 408 however, is now cold and very close to 100% relative humidity (saturated). Oftentimes and particularly in outdoor conditions that are not very warm but humid such as on a rainy spring day, the air CC 408 coming directly from the cooling coil 10 can be uncomfortably cold. In order to increase occupant comfort and control space humidity, the air 408 is re-heated to a warmer temperature. There are several ways to accomplish this, such as using a hot water coil with hot water fed from a boiler or a steam coil receiving heat from a steam generator or by using electric resistance heaters. This heating of air results in an additional heat load on the cooling system. More modern systems use an optional re-heat coil 409 which contains hot refrigerant from a compressor 416. The re-heat coil 409 heats the air stream 408 to a warmer air stream HC 410, which is then recirculated back to the space, provides occupant comfort and allows one to better control humidity in the space.

The compressor 416 receives a refrigerant through line 423 and receives power through conductor 417. The refrigerant can be any suitable refrigerant such as R410A, R407A, R134A, R1234YF, Propane, Ammonia, $CO_2$, etc. The refrigerant is compressed by the compressor 416 and compressed refrigerant is conducted to a condenser coil 414 through line 418. The condenser coil 414 receives outside air OA 411, which is blown through the coil 414 by fan 413, which receives power through conductor 412. The resulting exhaust air stream EA 415 carries with it the heat of compression generated by the compressor. The refrigerant condenses in the condenser coil 414 and the resulting cooler, (partially) liquid refrigerant 419 is conducted to the re-heat coil 409 where additional heat is removed from the refrigerant, which turns into a liquid in this stage. The liquid refrigerant in line 420 is then conducted to expansion valve 421 before reaching the cooling coil 405. The cooling coil 405 receives liquid refrigerant at pressure of typically 50-200 psi through line 422. The cooling coil 405 absorbs heat from the air stream MA 404 which re-evaporates the refrigerant which is then conducted through line 423 back to the compressor 416. The pressure of the refrigerant in line 418 is typically 300-600 psi. In some instances the system can have multiple cooling coils 405, fans 407 and expansion valves 421 as well as compressors 416 and condenser coils 414 and condenser fans 413. Oftentimes the system also has additional components in the refrigerant circuit or the sequence of components is ordered differently which are all well known in the art. As will be shown later, one of these components can be a diverter valve 426 which bypasses the re-heat coil 409 in winter mode. There are many variations of the basic design described above, but all recirculating rooftop units generally have a cooling coil that condenses moisture and introduce a small amount of outside air that is added to a main air stream that returns from the space, is cooled and dehumidified and the ducted back to the space. In many instances the larges load is the dehumidification of outside air and dealing with the reheat energy, as well as the average fan power required to move the air.

The primary electrical energy consuming components are the compressor 416 through electrical line 417, the condenser fan electrical motor through supply line 412 and the evaporator fan motor through line 406. In general the compressor uses close to 80% of the electricity required to operate the system, with the condenser and evaporator fans taking about 10% of the electricity each at peak load. However when one averages power consumption over the year, the average fan power is closer to 40% of the total load since fans generally run all the time and the compressor switches off on an as needed basis. In a typical RTU of 10 ton (35 kW) cooling capacity, the air flow RA is around 4,000 CFM. The amount of outside air OA mixed in is between 5% and 25% so between 200 and 1,000 CFM. Clearly the larger the amount of outside air results in larger cooling loads on the system. The return air that is exhausted EA2 is roughly equal to the amount of outside air taken in so between 200 and 1,000 CFM. The condenser coil 414 is generally operated with a larger air flow than the evaporator coil 405 of about 2,000 CFM for a 10 ton RTU. This allows the condenser to be more efficient and reject the heat of compression more efficiently to the outside air OA.

Figure 4B:
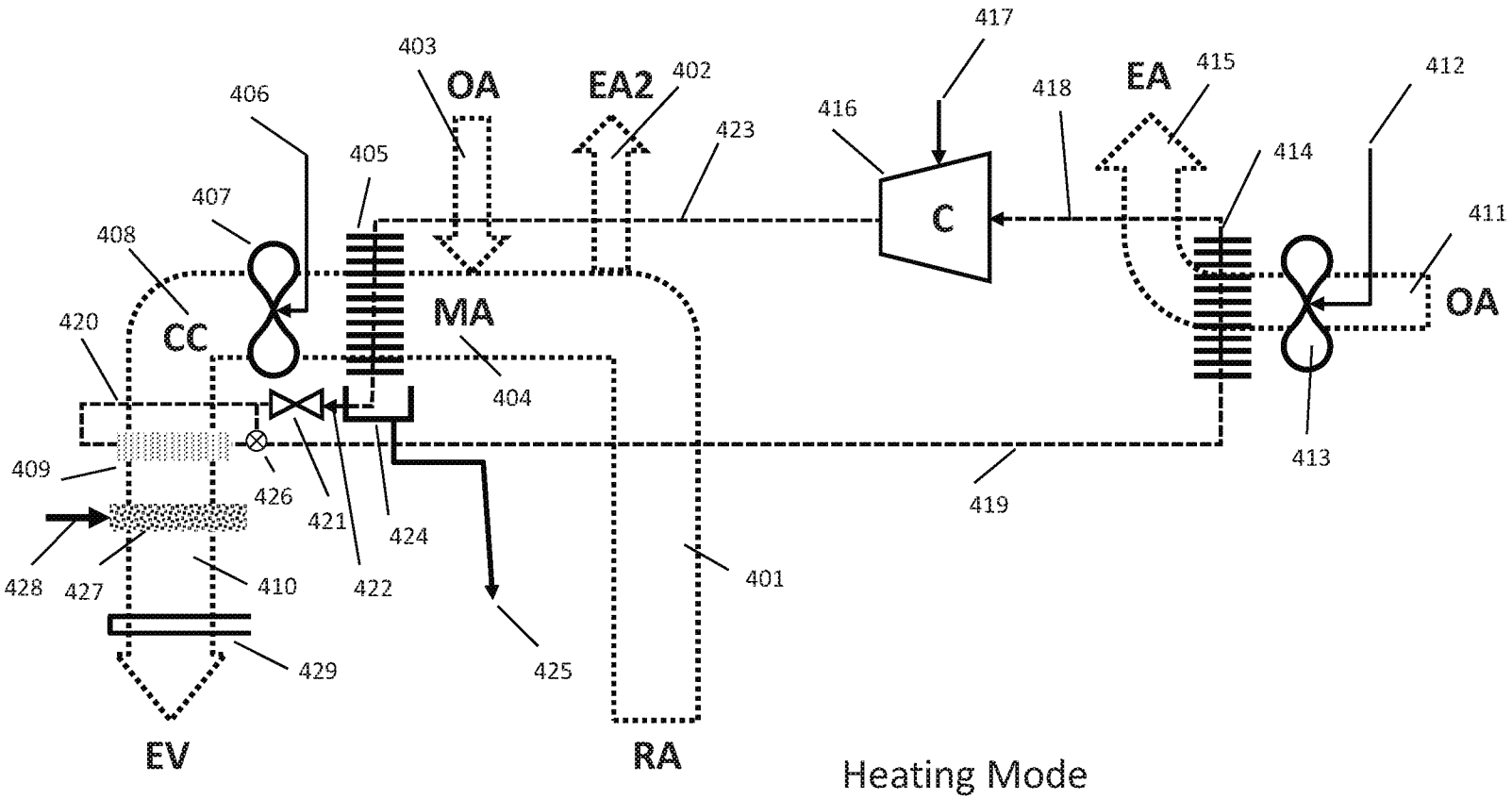
FIG. 4B schematically illustrates a conventional mini-split air conditioning system operating in a heating mode.

FIG. 4B is a schematic diagram of the system of FIG. 4A operating in a winter heating mode as a heat pump. Not all RTUs are heat pumps, and generally a cooling only system as shown in FIG. 4A can be used, possibly supplemented with a simple gas or electric furnace air heater. However, heat pumps are gaining popularity particularly in moderate climates since they can provide heating as well as cooling with better efficiency than electric heat and without the need to run gas lines to the RTU. For ease of illustration, the flow of refrigerant from the compressor 417 has simply been reversed. In actuality the refrigerant is usually diverted by a 4-way valve circuit which accomplishes the same effect. As the compressor produces hot refrigerant in line 423 which is now conducted to the coil 405, which is now functioning as a condenser rather than an evaporator. The heat of compression is carried to the mixed air stream MA 404 resulting in a warm air stream CC 408. Again, the mixed air stream MA 404 is the result of removing some air EA2 402 from the return air RA 401 and replacing it with outside air OA 403. The warm air stream CC 408 however is now relatively dry because heating by the condenser coil 405 results in air with low relative humidity and thus oftentimes a humidification system 427 is added to provide the required humidity for occupant comfort. The humidification system 427 requires a water supply 428. However this humidification also results in a cooling effect, meaning that the air stream 408 has to be overheated to compensate for the cooling effect of the humidifier 427. The refrigerant 422 leaving the coil 405 then enters the expansion valve 421 which results in a cold refrigerant stream in line 420, which is why diverter valve 426 can be used to bypass the re-heat coil 409. This diverts the cold refrigerant to coil 414 which is now functioning as an evaporator coil. The cold outside air OA 411 is blown by fan 413 through the evaporator coil 414. The cold refrigerant in line 419 now results in the exhaust air EA 415 to be even colder. This effect can result in water vapor in the outside air OA 411 to condense on the coil 414 which now runs the risk of ice formation on the coil. For that reason, in heat pumps, the refrigerant flow is regularly switched back from heating mode to cooling mode resulting in a warming of the coil 414 which allows ice to fall off the coil, but also resulting in much worse energy performance in winter. Furthermore, particularly in cold climates, it is common that the heating capacity of a system for winter heating needs to be about twice the cooling capacity of the system for summer cooling. It is therefore common to find supplemental heating systems 429 that heat the air stream EV 410 further before it returns to the space. Such supplemental systems can be gas furnaces, electric resistance heaters and the like. These additional components add a significant amount to the air stream pressure drop resulting in more power required for fan 407. The reheat coil—even if not active—can still be in the air stream as are the humidification system and heating components.

Figure 5A:
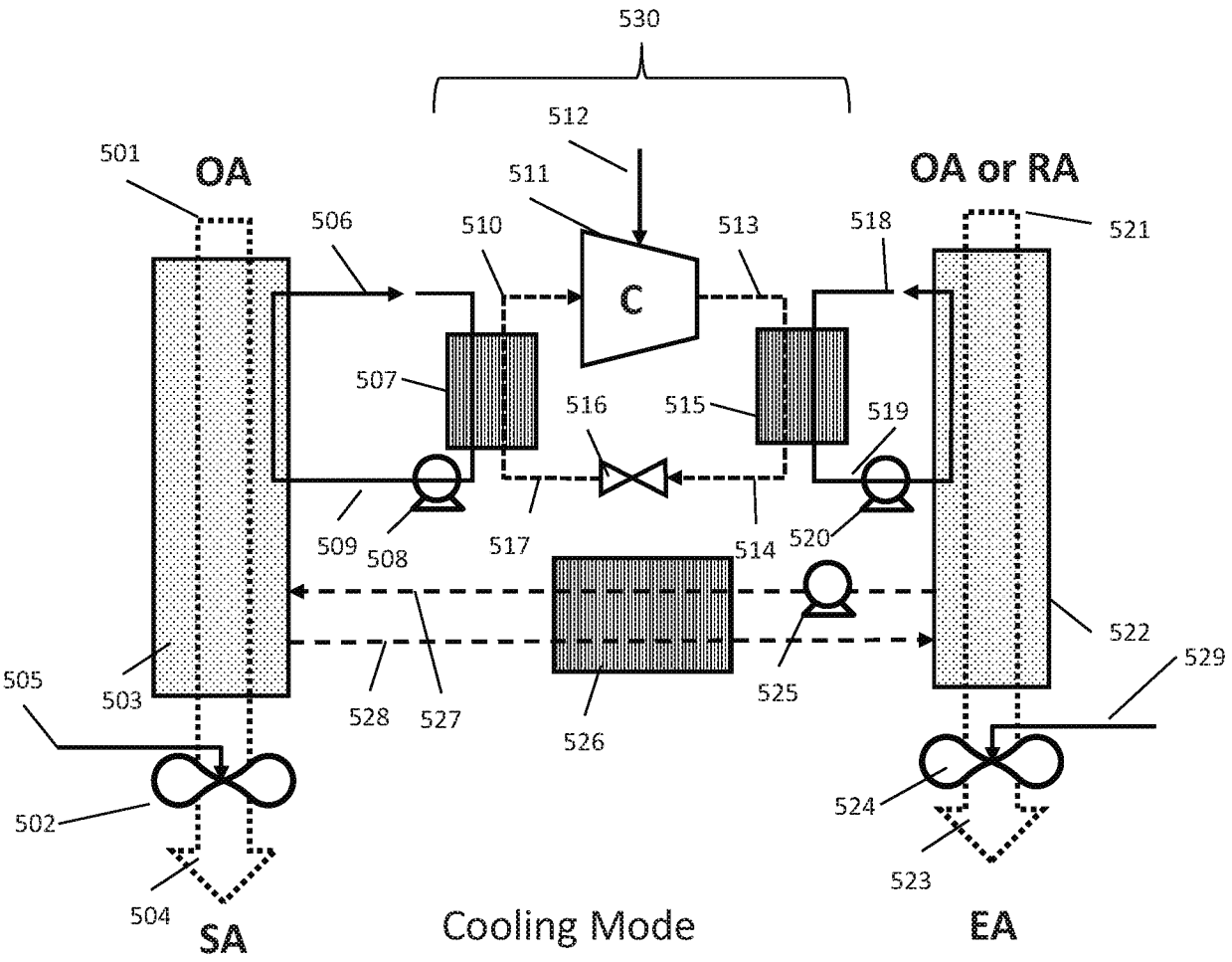
FIG. 5A schematically illustrates an exemplary chiller assisted liquid desiccant air conditioning system for 100% outside air in a summer cooling mode.

FIG. 5A illustrates a schematic representation of a liquid desiccant air conditioner system. A 3-way heat and mass exchanger conditioner 503 (which is similar to the conditioner 101 of FIG. 1) receives an air stream 501 from the outside ("OA"). Fan 502 pulls the air 501 through the conditioner 503 wherein the air is cooled and dehumidified. The resulting cool, dry air 504 ("SA") is supplied to a space for occupant comfort. The 3-way conditioner 503 receives a concentrated desiccant 527 in the manner explained under FIGS. 1-3. It is preferable to use a membrane on the 3-way conditioner 503 to contain the desiccant and inhibit it from being distributed into the air stream 504. The diluted desiccant 528, which contains the captured water vapor is transported to a heat and mass exchanger regenerator 522. Furthermore chilled water 509 is provided by pump 508, which enters the conditioner module 503 where it picks up heat from the air as well as latent heat released by the capture of water vapor in the desiccant 527. The warmer water 506 is brought to the heat exchanger 507 on the chiller system 530. It is worth noting that the system of FIG. 5A does not require a condensate drain line like line 425 in FIG. 4A. Rather, any moisture that is condensed into the desiccant is removed as part of the desiccant itself. This also eliminates problems with mold growth in standing water that can occur in the conventional RTU condensate pan 424 systems of FIG. 4A.

The liquid desiccant 528 leaves the conditioner 503 and is moved through the optional heat exchanger 526 to the regenerator 522 by pump 525.

The chiller system 530 comprises a water to refrigerant evaporator heat exchanger 507 which cools the circulating cooling fluid 506. The liquid, cold refrigerant 517 evaporates in the heat exchanger 507 thereby absorbing the thermal energy from the cooling fluid 506. The gaseous refrigerant 510 is now re-compressed by compressor 511. The compressor 511 ejects hot refrigerant gas 513, which is liquefied in the condenser heat exchanger 515. The liquid refrigerant exiting the condenser 514 then enters expansion valve 516, where it rapidly cools and exits at a lower pressure. The condenser heat exchanger 515 now releases heat to another cooling fluid loop 519 which brings hot heat transfer fluid 518 to the regenerator 522. Circulating pump 520 brings the heat transfer fluid back to the condenser 515. The 3-way regenerator 522 thus receives a dilute liquid desiccant 528 and hot heat transfer fluid 518. A fan 524 brings outside air 521 ("OA") through the regenerator 522. The outside air picks up heat and moisture from the heat transfer fluid 518 and desiccant 528 which results in hot humid exhaust air ("EA") 523.

The compressor 511 receives electrical power 512 and typically accounts for 80% of electrical power consumption of the system. The fans 502 and 524 also receive electrical power 505 and 529 respectively and account for most of the remaining power consumption. Pumps 508, 520 and 525 have relatively low power consumption. The compressor 511 will operate more efficiently than the compressor 416 in FIG. 4A for several reasons: the evaporator 507 in FIG. 5A will typically operate at higher temperature than the evaporator 405 in FIG. 4A because the liquid desiccant will condense water at much higher temperature without needing to reach saturation levels in the air stream. Furthermore the condenser 515 in FIG. 5A will operate at lower temperatures than the condenser 414 in FIG. 4A because of the evaporation occurring on the regenerator 522 which effectively keeps the condenser 515 cooler. As a result the system of FIG. 5A will use about 40% less electricity than the system of FIG. 4A for similar compressor isentropic efficiencies.

Figure 5B:
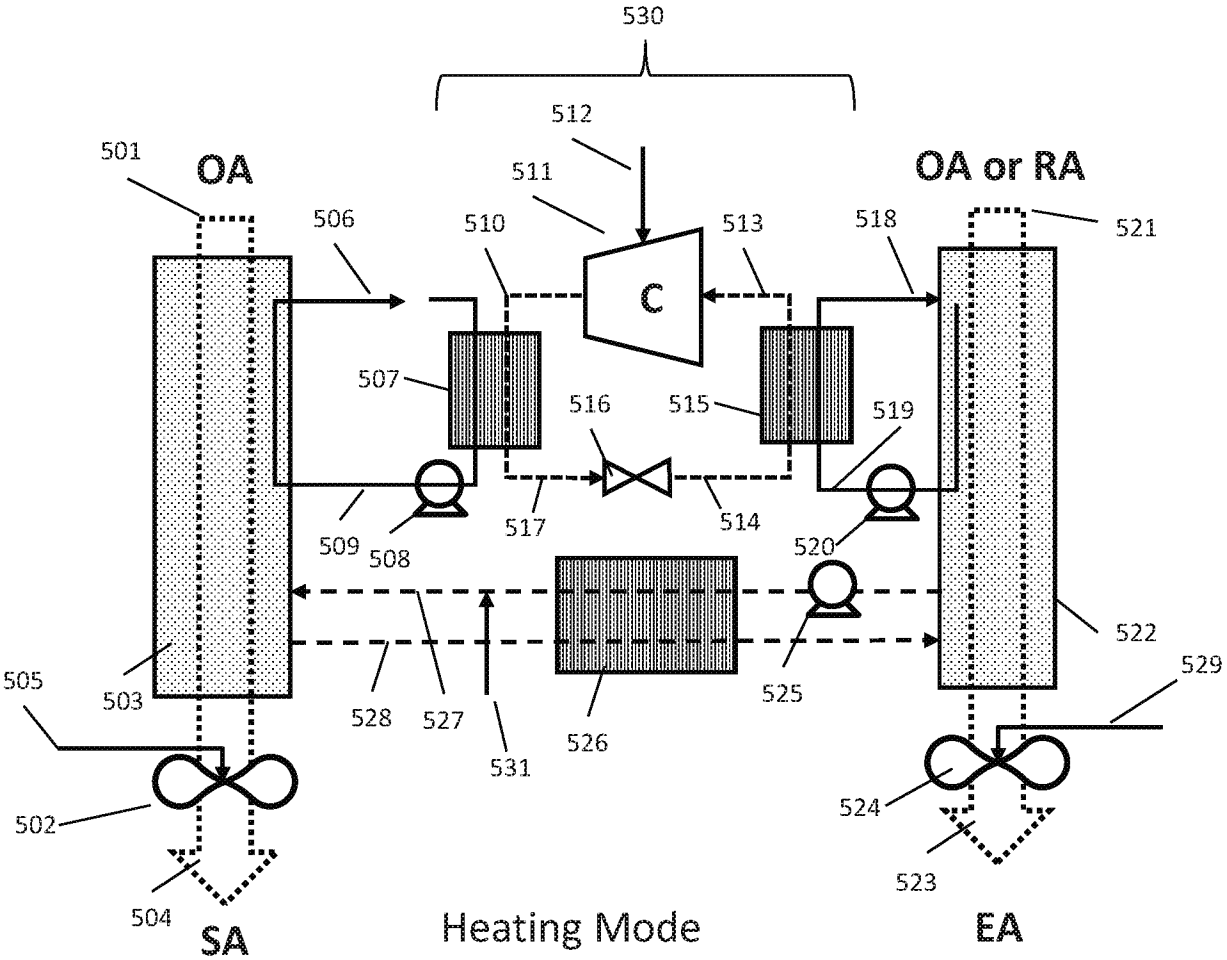
FIG. 5B schematically illustrates an exemplary chiller assisted liquid desiccant air conditioning system for 100% outside air in a winter heating mode.

FIG. 5B shows essentially the same system as FIG. 5A except that the compressor 511's refrigerant direction has been reversed as indicated by the arrows on refrigerant lines 514 and 510. Reversing the direction of refrigerant flow can be achieved by a 4-way reversing valve (not shown) or other convenient means in the chiller 530. It is also possible to instead of reversing the refrigerant flow to direct the hot heat transfer fluid 518 to the conditioner 503 and the cold heat transfer fluid 506 to the regenerator 522. This will provide heat to the conditioner which will now create hot, humid air 504 for the space for operation in winter mode. In effect the system is now working as a heat pump, pumping heat from the outside air 521 to the space supply air 504. However unlike the system of FIG. 4A, which is oftentimes also reversible, there is much less of a risk of the coil freezing because the desiccant usually has much lower crystallization limit than water vapor. In the system of FIG. 4B, the air stream 411 contains water vapor and if the evaporator coil 414 gets too cold, this moisture will condense on the surfaces and create ice formation on the coil. The same moisture in the regenerator 522 of FIG. 5B will condense in the liquid desiccant which—when managed properly—will not crystallize until −60° C. for some desiccants such as LiCl and water. This will allow the system to continue to operate at much lower outside air temperatures without freezing risk.

As before in FIG. 5A, outside air 501 is directed through the conditioner 503 by fan 502 which is operated by electrical power 505. The compressor 511 discharges hot refrigerant through line 510 into condenser heat exchanger 507 and out through line 510. The heat exchanger rejects heat to heat transfer fluid circulated by pump 508 through line 509 into the conditioner 503 which results in the air stream 501 picking up heat and moisture from the desiccant. Dilute desiccant is supplied by line 527 to the conditioner. The dilute desiccant is directed from regenerator 522 by pump 525 through heat exchanger 526. However in winter conditions it is possible that not enough water is recovered in the regenerator 522 to compensate for the water lost in the conditioner 503 which is why additional water 531 can be added to the liquid desiccant in line 527. Concentrated liquid desiccant is collected from the conditioner 503 and drained through line 528 and heat exchanger 526 to the regenerator 522. The regenerator 522 takes in either outside air OA or preferably return air RA 521 which is directed through the regenerator by fan 524 which is powered by electrical connection 529. Return air is preferred because is usually much warmer and contains much more moisture than outside air, which allows the regenerator to capture more heat and moisture from the air stream 521. The regenerator 522 thus produces colder, drier exhaust air EA 523. A heat transfer fluid in line 518 absorbs heat from the regenerator 522 which is pumped by pump 520 to heat exchanger 515. The heat exchanger 515 received cold refrigerant from expansion valve 516 through line 514 and the heated refrigerant is conducted through line 513 back to the compressor 511 which receives power from conductor 512.

Figure 6:
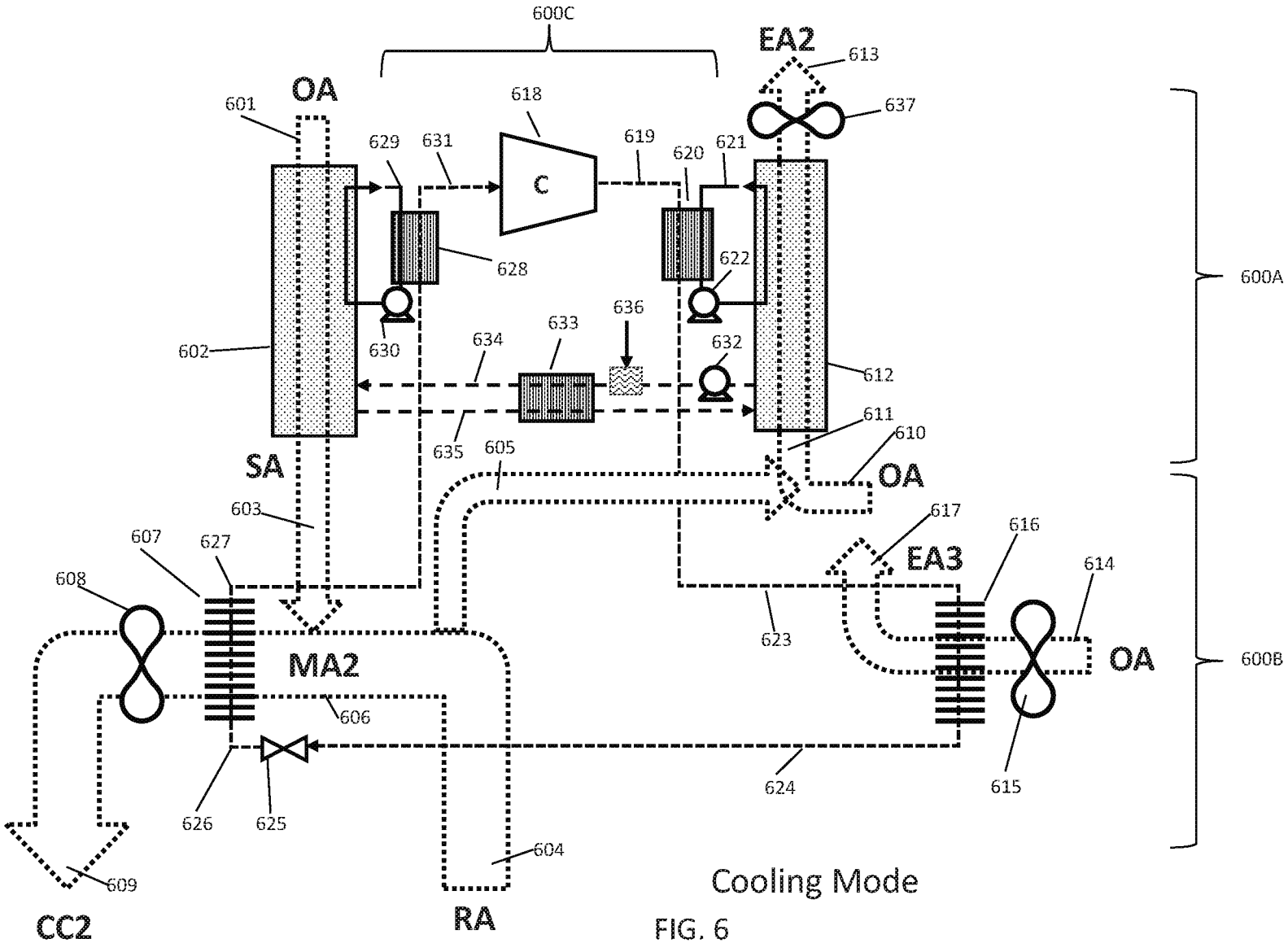
FIG. 6 schematically illustrates an exemplary chiller assisted partial outside air liquid desiccant air conditioning system using a 3-way heat and mass exchanger in a summer cooling mode in accordance with one or more embodiments.

FIG. 6 illustrates an air-conditioning system in accordance with one or more embodiments wherein a modified liquid desiccant section 600A is connected to a modified RTU section 600B but wherein the two systems share a single chiller system 600C. The outside air OA 601 which as shown in FIG. 4A is typically 5-25% of the return air stream RA 604, is now directed through the conditioner 602 which is similar in construction to the 3-way heat and mass exchange conditioner described in FIG. 2. The conditioner 602 can be significantly smaller than the conditioner 503 of FIG. 5A because the air stream 601 is much smaller than in the 100% outside air stream 501 of FIG. 5A. The conditioner 602 produces a colder, dehumidified air stream SA 603 which is mixed with the return air RA 604 to make mixed air MA2 606. Excess return air 605 is directed out of the system or towards the regenerator 612. The mixed air MA2 is pulled by fan 608 through evaporator coil 607 which primarily provides sensible only cooling so that the coil 607 can be much shallower and less expensive than the coil 405 in FIG. 4A which needs to be deeper to allow moisture to condense. The resulting air stream CC2 609 is ducted to the space to be cooled. The regenerator 612 receives either outside air OA 610 or the excess return air 605 or a mixture 611 thereof.

The regenerator air stream 611 can be pulled through the regenerator 612 which again is similar in construction to the 3-way heat and mass exchanger described in FIG. 2 by a fan 637 and the resulting exhaust air stream EA2 613 is generally much warmer and contains more water vapor than the mixed air stream 611 that is entering. Heat is provided by circulating a heat transfer fluid through line 621 using pump 622.

The compressor 618 compresses a refrigerant similar to the compressors in FIG. 4A and FIG. 5A. The hot refrigerant gas is conducted through line 619 to a condenser heat exchanger 620. A smaller amount of heat is conducted through this liquid-to-refrigerant heat exchanger 620 into the heat transfer fluid in circuit 621. The still hot refrigerant is now conducted through line 623 to a condenser coil 616, which receives outside air OA 614 from fan 615. The resulting hot exhaust air EA3 617 is ejected into the environment. The refrigerant which is now a cooler liquid after exiting the condenser coil 616 is conducted through line 624 to an expansion valve 625, where it is expanded and becomes cold. The cold liquid refrigerant is conducted through line 626 to the evaporator coil 607 where it absorbs heat from the mixed air stream MA2 606. The still relatively cold refrigerant which has partially evaporated in the coil 607 is now conducted through line 627 to evaporator heat exchanger 628 where additional heat is removed from the heat transfer fluid circulating in line 629 by pump 630. Finally the gaseous refrigerant exiting the heat exchanger 628 is conducted through line 631 back to the compressor 618.

In addition, a liquid desiccant is circulated between the conditioner 602 and the regenerator 612 through lines 635, the heat exchanger 633 and is circulated back to the conditioner by pump 632 and through line 634. Optionally a water-injection module 636 can be added to one or both of the desiccant lines 634 and 635. Such a module injects water into the desiccant in order to reduce the concentration of the desiccant and is described in FIG. 12 in more detail. Water injection is useful in conditions in which the desiccant concentration gets higher than desired, e.g., in hot, dry conditions such as can occur in the summer or in cold, dry conditions such as can occur in winter which will be described in more detail in FIG. 7.

Figure 7:
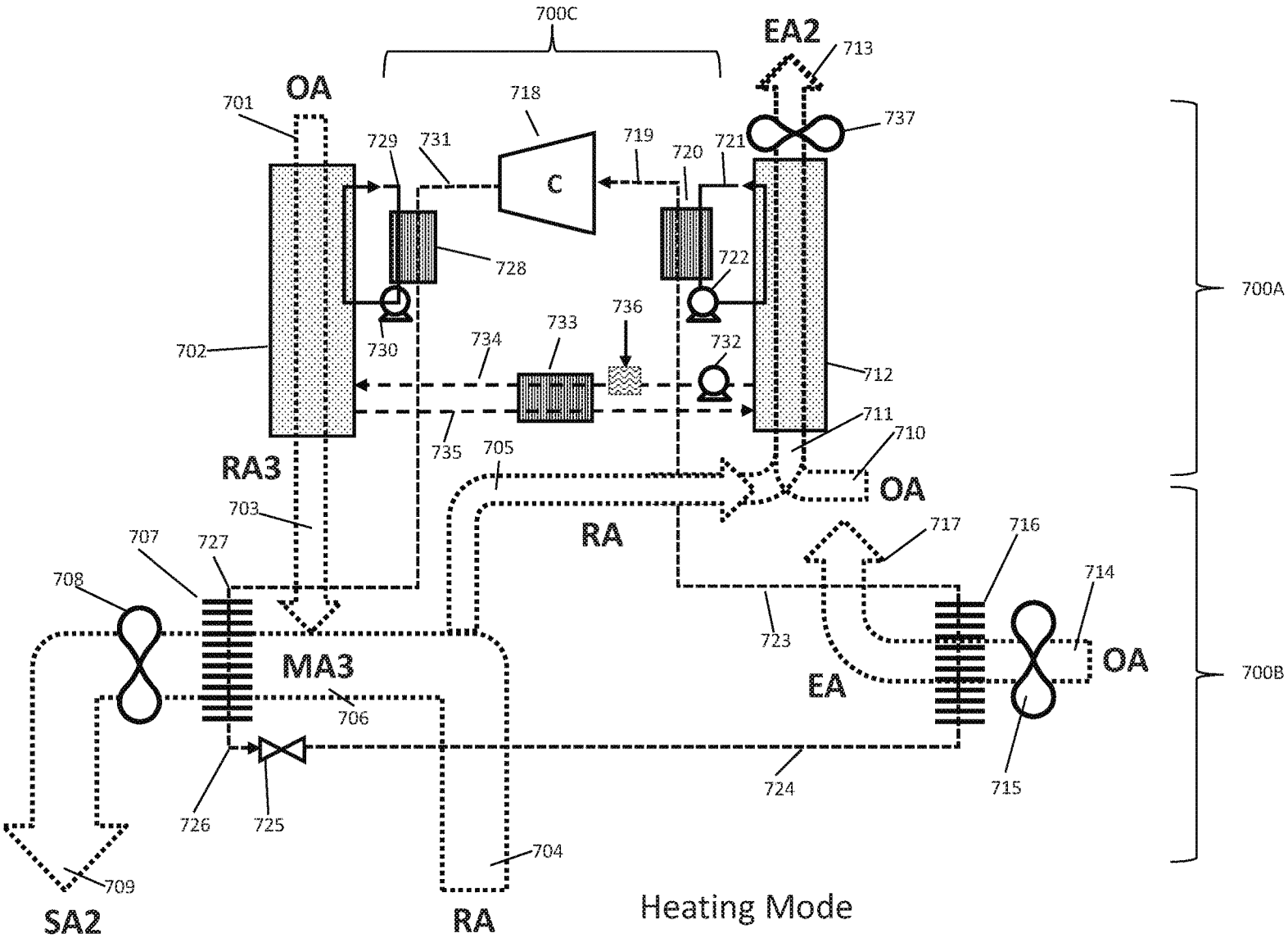
FIG. 7 schematically illustrates an exemplary chiller assisted partial outside air liquid desiccant air conditioning system using a 3-way heat and mass exchanger in a heating mode in accordance with one or more embodiments.

FIG. 7 illustrates an embodiment of the present invention of FIG. 6, wherein a modified liquid desiccant section 700A is connected to a modified RTU section 700B but wherein the two systems share a single chiller system 700C operating in a heating mode. The outside air OA 701 which as shown in FIG. 4B is typically 5-25% of the return air stream RA 704, is now directed through the conditioner 702 which is similar in construction to the 3-way heat and mass exchange conditioner described in FIG. 2. The conditioner 702 can be significantly smaller than the conditioner 503 of FIG. 5B because the air stream 701 is much smaller than in the 100% outside air stream 501 of FIG. 5B. The conditioner 702 produces a warmer, humidified air stream RA3 703 which is mixed with the return air RA 704 to make mixed air MA3 706. Excess return air RA 705 is directed out of the system or towards the regenerator 712. The mixed air MA3 706 is pulled by fan 708 through condenser coil 707 which provides sensible only heating. The resulting air stream SA2 709 is ducted to the space to be heated and humidified. The regenerator 712 receives either outside air OA 710 or the excess return air RA 705 or a mixture 711 thereof.

The regenerator air stream 711 can be pulled through the regenerator 712 which again is similar in construction to the 3-way heat and mass exchanger described in FIG. 2 by a fan 737 and the resulting exhaust air stream EA2 713 is generally much colder and contains less water vapor than the mixed air stream 711 that is entering. Heat is removed by circulating a heat transfer fluid through line 721 using pump 722.

The compressor 718 compresses a refrigerant similar to the compressors in FIG. 4B and FIG. 5B. The hot refrigerant gas is conducted through line 731 to a condenser heat exchanger 728, which is the same heat exchanger 628 in FIG. 6, but used as a condenser instead of an evaporator. A smaller amount of heat is conducted through this liquid-to-refrigerant heat exchanger 728 into the heat transfer fluid in circuit 729 by using pump 730. The still hot refrigerant is now conducted through line 727 to a condenser coil 707, which receives the mixed return air MA3 706. The resulting hot supply air SA2 709 is directed through a duct to the space to be heated and humidified. The refrigerant which is now a cooler liquid after exiting the condenser coil 707 is conducted through line 726 to an expansion valve 725, where it is expanded and becomes cold. The cold liquid refrigerant is conducted through line 724 to the evaporator coil 716 where it absorbs heat from the outside air stream OA 714 resulting in a cold exhaust air stream EA 717 which is emitted to the environment by using fan 715. The still relatively cold refrigerant which has partially evaporated in the coil 716 is now conducted through line 723 to evaporator heat exchanger 720 where additional heat is removed from the air stream 711 going through the regenerator 712 by transfer fluid circulating in line 721 by using pump 722. Finally the gaseous refrigerant exiting the heat exchanger 720 is conducted through line 719 back to the compressor 718.

In addition, a liquid refrigerant is circulated between the conditioner 702 and the regenerator 712 through lines 735, the heat exchanger 733 and is circulated back to the conditioner by pump 732 and through line 734. In some conditions, for example when both the return air RA 705 and the outside air OA 710 are relatively dry, it is possible that the conditioner 702 provides more moisture to the space than is collected in the regenerator 712. In that case a provision for adding water 736 is required to maintain the desiccant at the proper concentration. A provision for adding water 736 can be provided in any location that gives convenient access to the desiccant, however the water added, should be relatively pure since a lot of water will evaporate, which is why reverse osmosis or de-ionized or distilled water would be preferable to straight tap water. This provision for adding water 736 will be discussed in more detail in FIG. 12.

The advantages of integrating a system in the configuration of FIG. 6 and FIG. 7 are several. The combination of 3-way liquid desiccant heat exchanger modules and a shared compressor system allows one to combine the advantages of dehumidification without condensation that are possible in the 3-way heat and mass exchanger with the inexpensive construction of a conventional RTU, whereby the integrated solution becomes very cost competitive. As mentioned before, the coil 607 can be thinner, since no moisture condensation is needed, and the condensate pan and drain from FIG. 4A can be eliminated. Furthermore as will be seen in FIG. 8, the overall cooling capacity of the compressor can be reduced and the condenser coil can be smaller as well. In addition, the heating mode of the system adds humidity to the air stream unlike any other heat pump in the market today. The refrigerant, desiccant and heat transfer fluid circuits are actually simpler than those in the systems of FIGS. 4A, 4B, 5A and 5B, and the supply air stream 609 and 709 encounter fewer components than the conventional systems of FIGS. 4A and 4B, which means less pressure drop in the air stream leading to additional energy savings.

Figure 8:
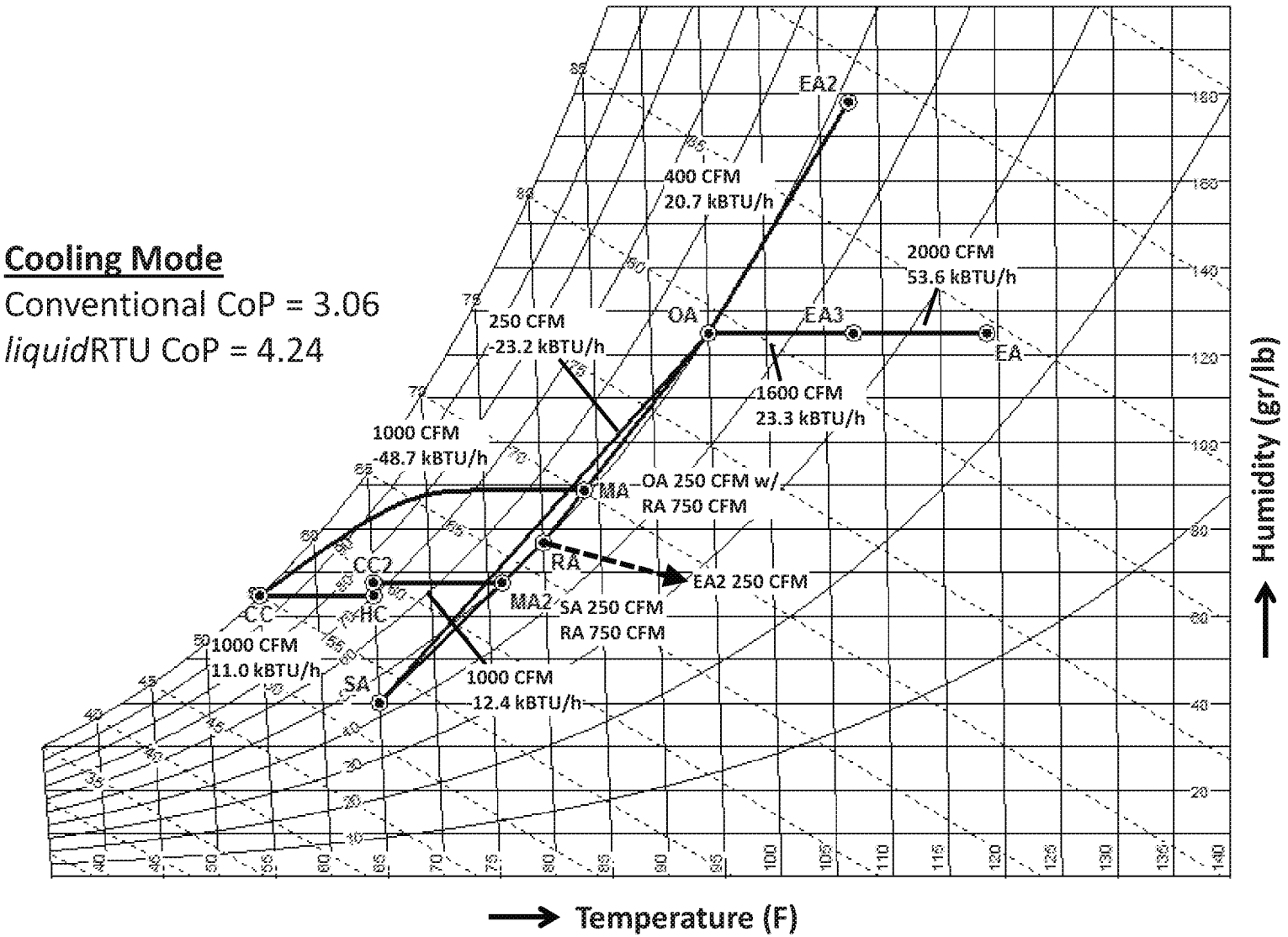
FIG. 8 illustrates the psychrometric processes involved in the cooling of air for a conventional RTU and the equivalent processes in a liquid-RTU.

FIG. 8 illustrates a psychrometric chart of the processes of FIG. 4A and FIG. 6. The horizontal axis denotes temperature in degrees Fahrenheit and the vertical axis denotes humidity in grains of water per pound of dry air. As can be seen in the figure, and by way of example, outside air OA is provided at 95F and 60% relative humidity (or 125 gr/lb). Also by example we selected a 1,000 CFM supply air requirement with a 25% outside air contribution (250 CFM) to the space at 65F and 70% RH (65 gr/lb). The conventional system of FIG. 4A takes in 1,000 CFM of return air RA at 80 F and 50% RH (78 gr/lb). 250 CFM of this return air RA is discarded as EA2 (the stream EA2 402 in FIG. 4A). 750 CFM of the return air RA is mixed with 250 CFM of outside air (the stream OA 403 in FIG. 4A) resulting in a mixed air condition MA (the stream MA 404 in FIG. 4A). The mixed air MA is directed through the evaporator coil resulting in a cooling and dehumidification process resulting in air CC leaving the coil at 55 F and 100% RH (65 gr/lb). In many cases that air is reheated (possibly by a small condenser coil as was shown in FIG. 4A) resulting in the actual supply air HC at 65 F and 70% RH (65 gr/lb).

The system of FIG. 6 under the same outside air conditions will create a supply air stream SA leaving the conditioner (602 in FIG. 6) at 65 F and 43% RH (40 gr/lb). This relatively dry air is now mixed with the 750 CFM of return air RA (604 in FIG. 6) resulting in mixed air condition MA2 (MA2 606 in FIG. 6). The mixed air MA2 is now directed through the evaporator coil (607 in FIG. 6) which sensible cools the air to supply air condition CC2 (CC2, 609 in FIG. 6). As can be seen in the figure and calculated from the psychrometrics, the cooling power of the conventional system is 48.7 kBTU/hr, whereas the cooling power of the system of FIG. 6 is 35.6 kBTU/hr (23.2 kBTU/hr for the outside air OA and 12.4 kBTU/hr for the mixed air MA2) thus requiring about a 27% smaller compressor.

Also shown in FIG. 8 is the change in the outside air OA used to reject heat. The conventional system of FIG. 4A use about 2,000 CFM through the condenser 414 to reject heat to the outside air OA (OA 411 in FIG. 4A) resulting in exhaust air EA at 119 F and 25% RH (125 gr/lb) (EA 415 in FIG. 4A). However, the system of FIG. 6 rejects two air streams, the regenerator 612 rejects air EA2 at 107 F and 49% RH (178 gr/lb) (EA2 613 in FIG. 6) which is hot and moist, as well as air stream EA3 at 107 F and 35% RH (125 gr/lb) (EA3 617 in FIG. 6). Because of the lower compressor capacity, less heat has to be rejected to the outside air resulting in a lower condenser temperature. The effects of lower compressor power and higher evaporator temperatures and lower condenser temperature as well as lower pressure drop in the main air stream in FIG. 6 combine make a system with much better energy performance than a conventional RTU as was shown in FIG. 4A.

Figure 9:
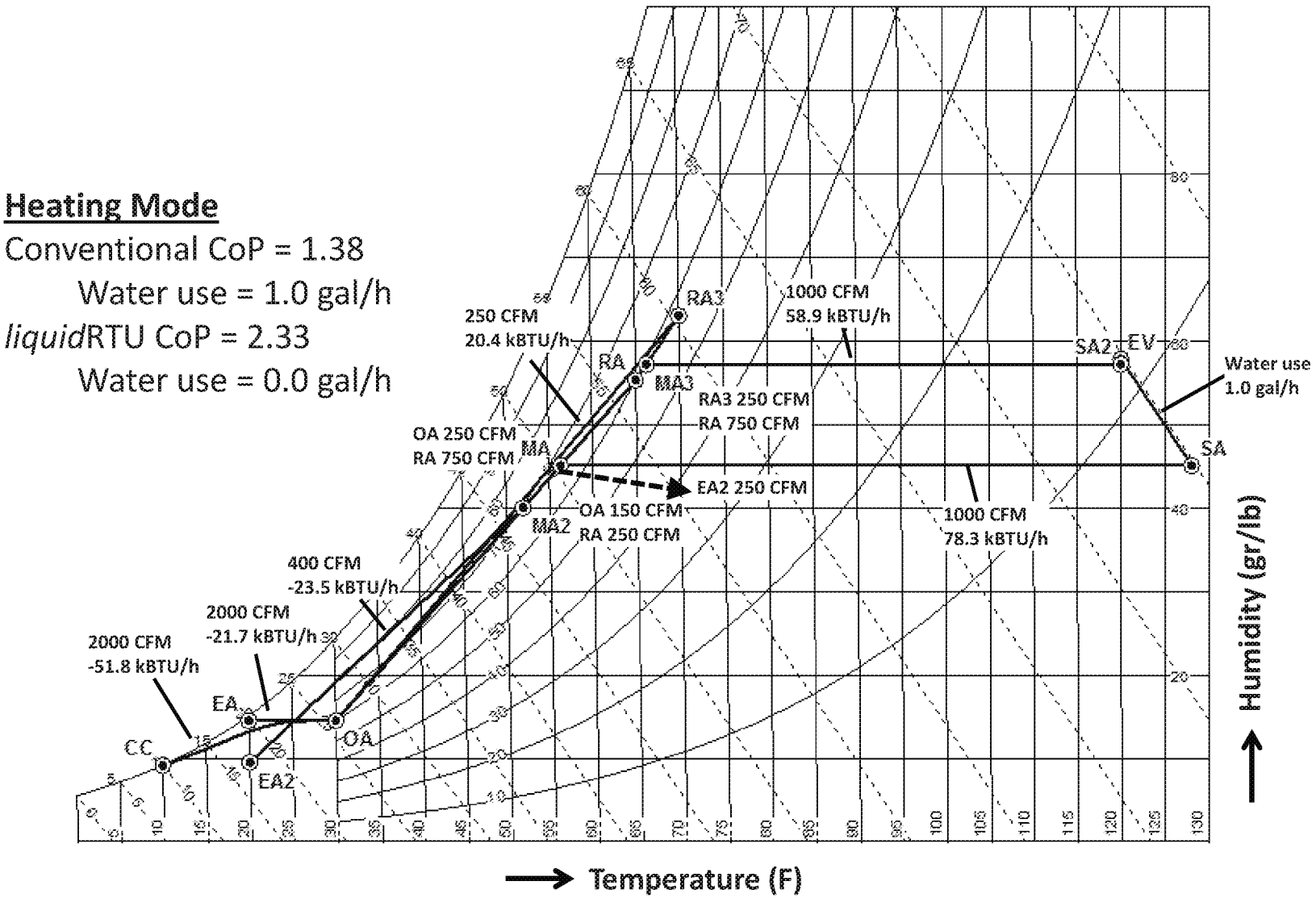
FIG. 9 illustrates the psychrometric processes involved in the heating of air for a conventional RTU and the equivalent processes in a liquid-RTU.

Likewise, FIG. 9 illustrates a psychrometric chart of the processes of FIG. 4B and FIG. 7. The horizontal axis denotes temperature in degrees Fahrenheit and the vertical axis denotes humidity in grains of water per pound of dry air. As can be seen in the figure, and by way of example, outside air OA is provided at 30 F and 60% relative humidity (or 14 gr/lb). Also by example we again selected a 1,000 CFM supply air requirement with a 25% outside air contribution (250 CFM) to the space at 120 F and 12% RH (58 gr/lb). The conventional system of FIG. 4B takes in 1,000 CFM of return air RA at 80 F and 50% RH (78 gr/lb). 250 CFM of this return air RA is discarded as EA2 (the stream EA2 402 in FIG. 4B). 750 CFM of the return air RA is mixed with 250 CFM of outside air (the stream OA 403 in FIG. 4B) resulting in a mixed air condition MA (the stream MA 404 in FIG. 4B). The mixed air MA is directed through the condenser coil (405 in FIG. 4B) resulting in a heating process resulting in air SA leaving the coil at 128 F and 8% RH (46 gr/lb). In many cases that air is too dry for occupant comfort and the air is receiving moisture from a humidification system (427 in FIG. 4B) resulting in the actual supply air EV at 120 F and 12% RH (58 gr/lb). Humidification can be done to a higher level, but as will be clear that would possibly result in an additional heating requirement. The water consumption of the evaporation in this example is around 1.0 gallon per hour.

The system of FIG. 7 under the same outside air conditions will create a supply air stream RA3 703 leaving the conditioner (702 in FIG. 7) at 70 F and 48% RH (63 gr/lb). This relatively moist air is now mixed with the 750 CFM of return air RA (704 in FIG. 7) resulting in mixed air condition MA3 (MA3 706 in FIG. 7). The mixed air MA3 is now directed through the condenser coil (707 in FIG. 7) which sensible heats the air to supply air condition SA2 (SA2, 709 in FIG. 7). As can be seen in the figure and calculated from the psychrometrics, the heating power of the conventional system is 78.3 kBTU/hr, whereas the heating power of the system of FIG. 7 is 79.3 kBTU/hr (20.4 kBTU/hr for the outside air OA and 58.9 kBTU/hr for the mixed air MA2) essentially the same as the system of FIG. 4B.

Also shown in FIG. 9 is the change in the outside air OA used to absorb heat. The conventional system of FIG. 4B use about 2,000 CFM through the evaporator 414 to absorb heat from the outside air OA (OA 411 in FIG. 4B) resulting in exhaust air EA at 20 F and 100% RH (9 gr/lb) (EA 415 in FIG. 4B). However, the system of FIG. 6 absorbs heat from two air streams, the regenerator 612 absorbs heat from air stream between MA2 (which comprises 250 CFM of RA air at 65 F and 60% RH or 55 gr/lb and 150 CFM of OA air at 30 F and 60% RH or 14 gr/lb for a mixed air condition MA2

(711 in FIG. 7) of 400 CFM of 52 F air at 70% RH or 40 gr/lb) and air stream EA2 at 20 F and 50% RH (10 gr/lb) (EA2 713 in FIG. 7) which is cool and dry, as well as air stream EA at 20 F and 95% RH (14 gr/lb) (EA 717 in FIG. 7). As can be seen in the figure this setup has three effects: the temperature of EA and EA2 is higher than the temperature CC, and thus the evaporator coil 707 of FIG. 6B runs at a higher temperature as the evaporator coil 405 which improves efficiency. Furthermore, the conditioner 702 is absorbing moisture from the mixed air stream MA2 which is subsequently released in the air stream MA3, eliminating the need for makeup water. And lastly, the evaporator coil 405 is condensing moisture as can be seen from the process between OA and CC in the figure. In practice this results in ice formation on the coil and the coil will thus have to be heated the remove ice buildup, which is usually done by switching the refrigerant flow in the direction of FIG. 6. The coil 707 does not reach saturation and will thus not have to be heated. As a result the actual cooling in coil 405 in the system of FIG. 4B is around 21.7 kBRU/hr, whereas the combination of coil 707 and conditioner 702 results in 45.2 kBTU/hr in the system of FIG. 7. This means a significantly better Coefficient of Performance (CoP) even though the heating output is the same and no water is consumed in the system of FIG. 7.

Figure 10:
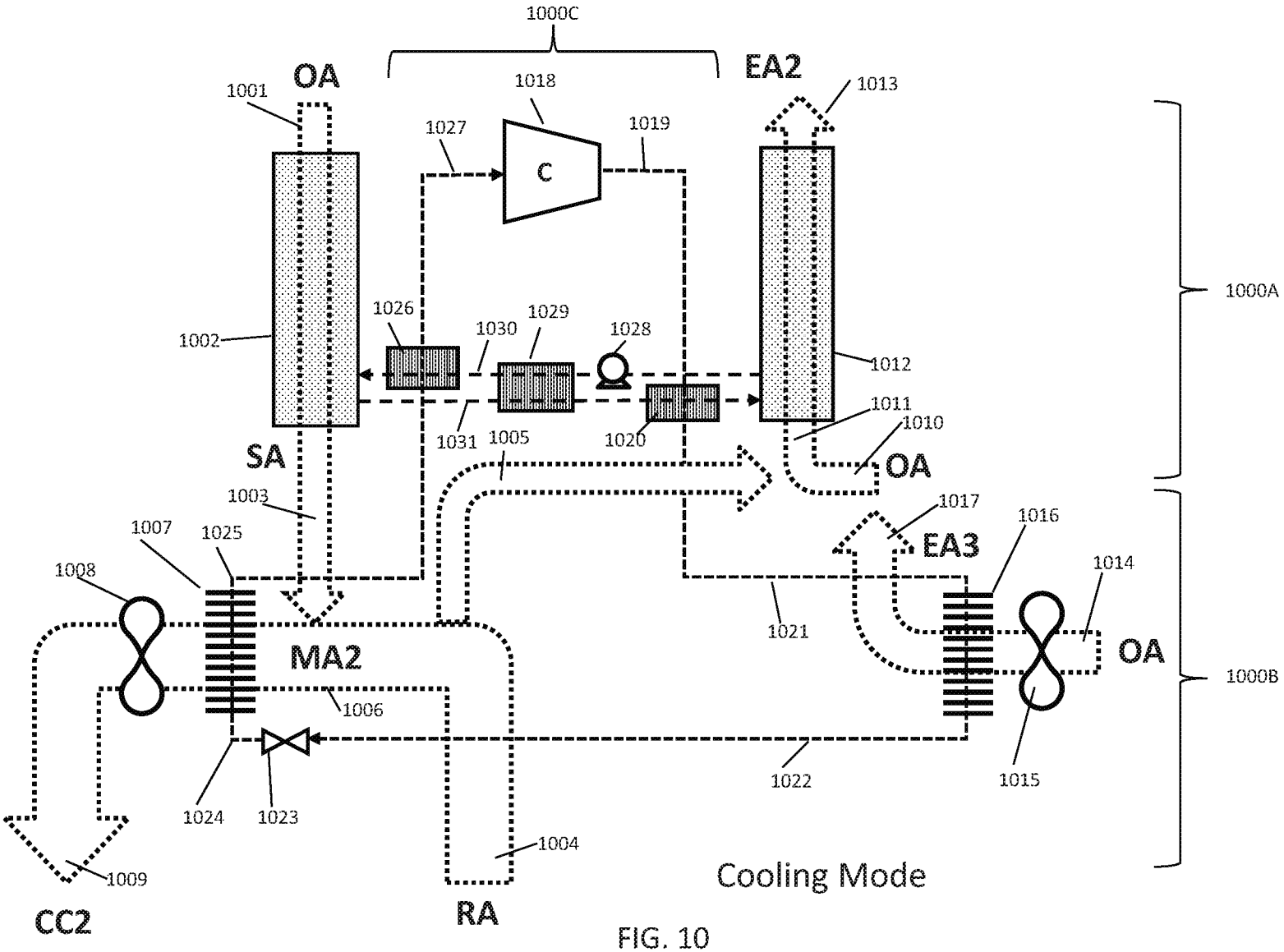
FIG. 10 schematically illustrates an exemplary chiller assisted partial outside air liquid desiccant air conditioning system using a 2-way heat and mass exchanger in a summer cooling mode in accordance with one or more embodiments wherein the liquid desiccant is pre-cooled and pre-heated before entering the heat and mass exchangers.

FIG. 10 illustrates an alternate embodiment of the system in FIG. 6, wherein the 3-way heat and mass exchangers 602 and 612 of FIG. 6 have been replaced by 2-way heat and mass exchangers. In two way heat and mass exchangers which are well known in the art, a desiccant is exposed directly to an air stream, sometimes with a membrane therebetween and sometimes without. Typically two-way heat and mass exchangers exhibit an adiabatic heat and mass transfer process since there often is no place for the latent heat of condensation to be absorbed, safe for the desiccant itself. This usually increases the required desiccant flow rate because the desiccant now has to function as a heat transfer fluid as well. Outside air 1001 is directed through the conditioner 1002 which produces a colder, dehumidified air stream SA 1003 which is mixed with the return air RA 1004 to make mixed air MA2 1006. Excess return air 1005 is directed out of the system or towards the regenerator 1012. The mixed air MA2 is pulled by fan 1008 through evaporator coil 1007 which primarily provides sensible only cooling. The resulting air stream CC2 1009 is ducted to the space to be cooled. The regenerator 1012 receives either outside air OA 1010 or the excess return air 1005 or a mixture 1011 thereof.

The regenerator air stream 1011 can be pulled through the regenerator 1012 which again is similar in construction to the 2-way heat and mass exchanger as used as a conditioner 1002 by a fan (not shown) and the resulting exhaust air stream EA2 1013 is generally much warmer and contains more water vapor than the mixed air stream 1011 that is entering.

The compressor 1018 compresses a refrigerant similar to the compressors in FIG. 4A, FIG. 5A and FIG. 6. The hot refrigerant gas is conducted through line 1019 to a condenser heat exchanger 1020. A smaller amount of heat is conducted through this liquid-to-refrigerant heat exchanger 1020 into the desiccant in line 1031. Since desiccant is often highly corrosive, the heat exchanger 1020 is made from Titanium or other suitable material. The still hot refrigerant is now conducted through line 1021 to a condenser coil 1016, which receives outside air OA 1014 from fan 1015. The resulting hot exhaust air EA3 1017 is ejected into the environment. The refrigerant which is now a cooler liquid after exiting the condenser coil 1016 is conducted through line 1022 to an expansion valve 1023, where it is expanded and becomes cold. The cold liquid refrigerant is conducted through line 1024 to the evaporator coil 1007 where it absorbs heat from the mixed air stream MA2 1006. The still relatively cold refrigerant which has partially evaporated in the coil 1007 is now conducted through line 1025 to evaporator heat exchanger 1026 where additional heat is removed from the liquid desiccant that is circulated to the conditioner 1002. As before the heat exchanger 1026 will have to be constructed from a corrosion resistant material such as Titanium. Finally the gaseous refrigerant exiting the heat exchanger 1026 is conducted through line 1027 back to the compressor 1018.

In addition, a liquid desiccant is circulated between the conditioner 1002 and the regenerator 1012 through lines 1030, the heat exchanger 1029 and is circulated back to the conditioner by pump 1028 and through line 1031.

Figure 11:
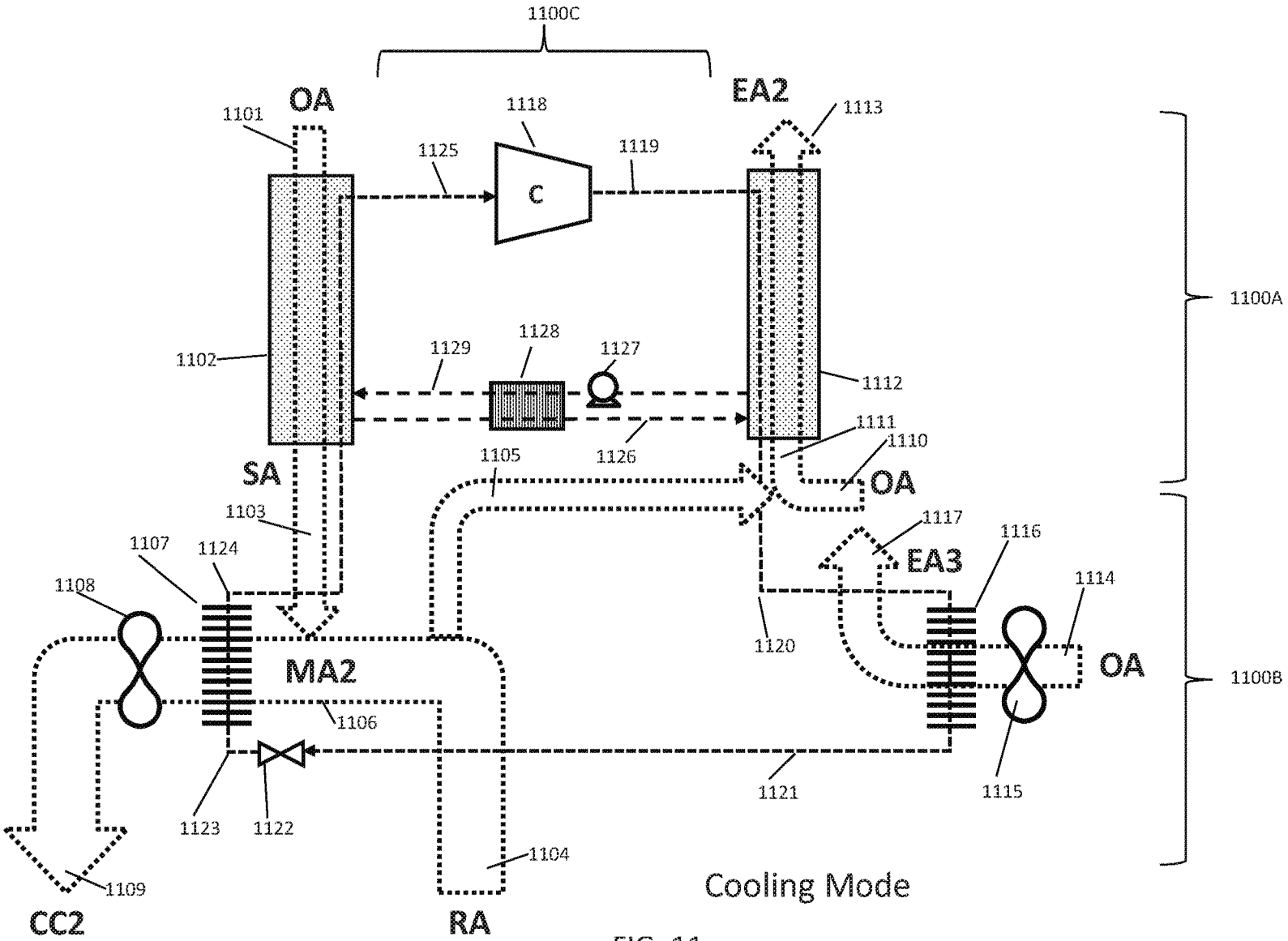
FIG. 11 schematically illustrates an exemplary chiller assisted partial outside air liquid desiccant air conditioning system using a 2-way heat and mass exchanger in a summer cooling mode in accordance with one or more embodiments wherein the liquid desiccant is cooled and heated inside the heat and mass exchangers.

FIG. 11 illustrates an alternate embodiment of the system in FIG. 10, wherein the 2-way heat and mass exchanger 1002 and the liquid to liquid heat exchangers 1026 of FIG. 10 have been integrated into single 3-way heat and mass exchangers where the air, the desiccant and the refrigerant exchange heat and mass simultaneously. In concept this is similar to using a refrigerant instead of a heat transfer fluid in FIG. 6. The same integration can be done on the regenerator 1012 and the heat exchanger 1020. These integrations essentially eliminate a heat exchanger on each side making the system more efficient.

Outside air 1101 is directed through the conditioner 1102 which produces a colder, dehumidified air stream SA 1103 which is mixed with the return air RA 1104 to make mixed air MA2 1106. Excess return air 1105 is directed out of the system or towards the regenerator 10112. The mixed air MA2 is pulled by fan 10108 through evaporator coil 1107 which primarily provides sensible only cooling. The resulting air stream CC2 1109 is ducted to the space to be cooled. The regenerator 11012 receives either outside air OA 1110 or the excess return air 1105 or a mixture 1111 thereof.

The regenerator air stream 1111 can be pulled through the regenerator 1112 which again is similar in construction to the 2-way heat and mass exchanger as used as a conditioner 1102 by a fan (not shown) and the resulting exhaust air stream EA2 1113 is generally much warmer and contains more water vapor than the mixed air stream 1111 that is entering.

The compressor 1118 compresses a refrigerant similar to the compressors in FIG. 4A, FIG. 5A, FIG. 6 and FIG. 10. The hot refrigerant gas is conducted through line 1119 to a 3-way condenser heat and mass exchanger 1112. A smaller amount of heat is conducted through this regenerator 1120 into the refrigerant in line 1119. Since desiccant is often highly corrosive, the regenerator 1112 needs to be constructed as for example is shown in FIG. 80 of application Ser. No. 13/915,262. The still hot refrigerant is now conducted through line 1120 to a condenser coil 1116, which receives outside air OA 1114 from fan 1115. The resulting hot exhaust air EA3 1117 is ejected into the environment. The refrigerant which is now a cooler liquid after exiting the condenser coil 1116 is conducted through line 1121 to an expansion valve 1122, where it is expanded and becomes cold. The cold liquid refrigerant is conducted through line 1123 to the evaporator coil 1107 where it absorbs heat from the mixed air stream MA2 1106. The still relatively cold refrigerant which has partially evaporated in the coil 1107 is now conducted through line 1124 to the evaporator heat exchanger/conditioner 1102 where additional heat is removed from the liquid desiccant. Finally the gaseous refrigerant exiting the conditioner 1102 is conducted through line 1125 back to the compressor 1118.

In addition, the liquid desiccant is circulated between the conditioner 1102 and the regenerator 1112 through lines 1129, the heat exchanger 1128 and is circulated back to the conditioner by pump 1127 and through line 1126.

The systems from FIG. 10 and FIG. 11 are also reversible for winter heating mode similar to the system in FIG. 7. Under some conditions in the winter heating mode, additional water should be added to maintain proper desiccant concentration because if too much water is evaporated in dry conditions, the desiccant is at risk of crystallizing. As mentioned, one option is to simply add reverse osmosis or de-ionized water to keep the desiccant dilute, but the processes to generate this water are also very energy intensive.

Figure 12:
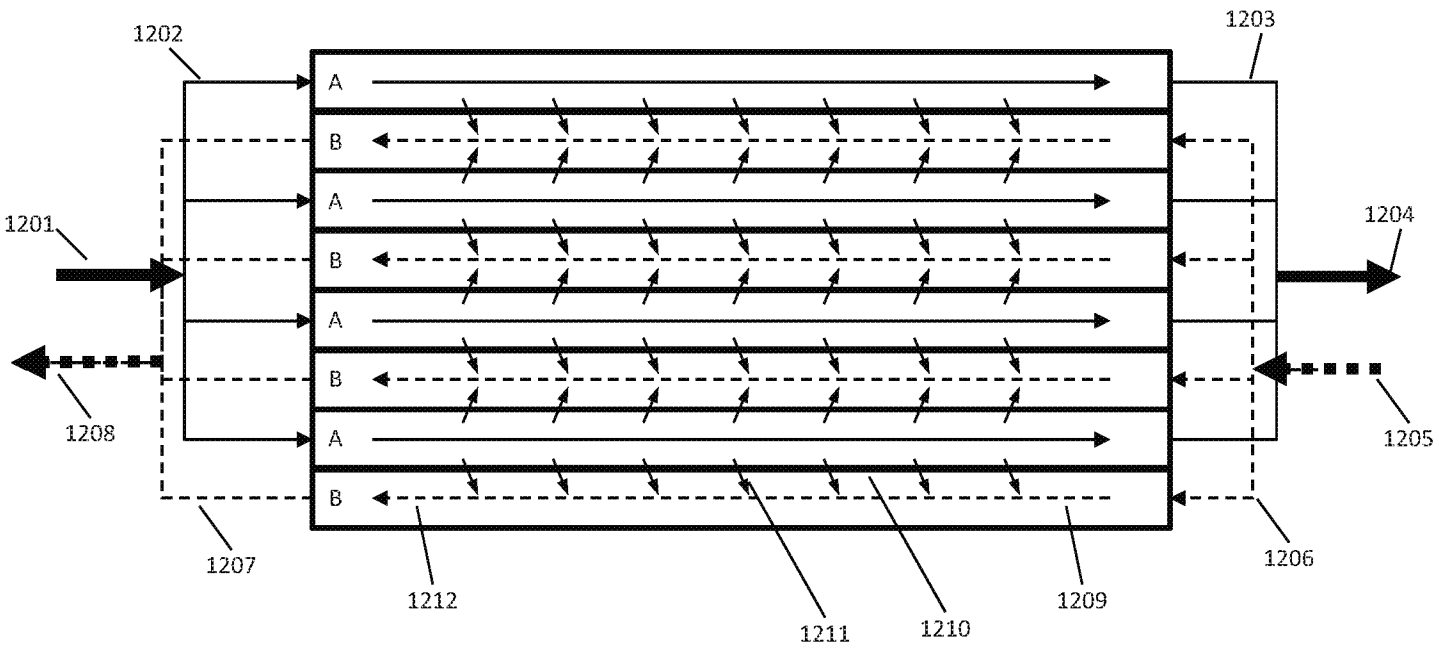
FIG. 12 illustrates a water extraction module that pulls pure water into the liquid desiccant for use in winter humidification mode.
Figure 13:
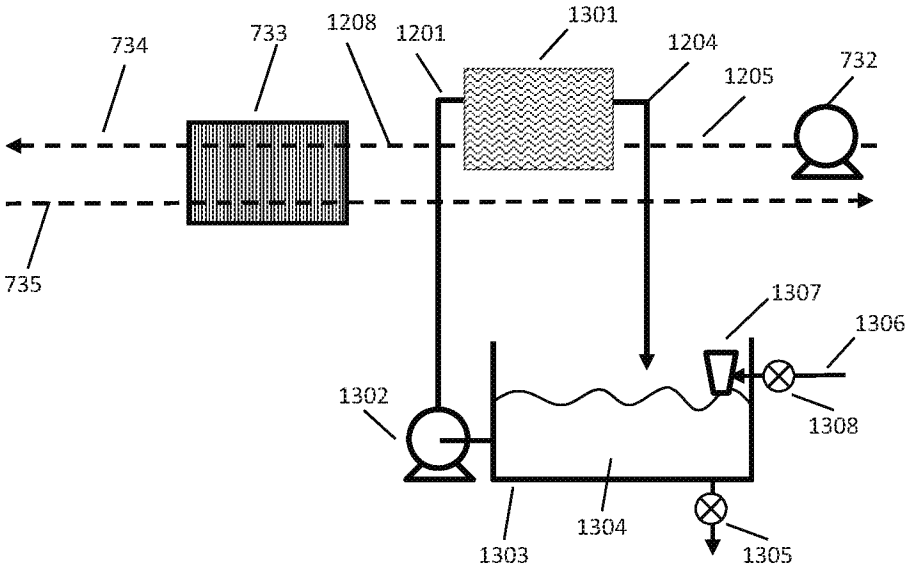
FIG. 13 shows how the water extraction module of FIG. 12 can be integrated into the system of FIG. 7.

FIG. 12 illustrates an embodiment of a much simpler water injection system that generates pure water directly into the liquid desiccant by taking advantage of the desiccants' ability to attract water. The structure in FIG. 12 (which was labeled 736 in FIG. 7) comprises a series of parallel channels, which can be flat plates or rolled up channels. Water enters the structure at 1201 and is distributed to several channels through distribution header 1202. This water can be tap water, sea water or even filtered waste water or any water containing fluid that has primarily water as a constituent and if any other materials are present, those materials are not transportable through the selective membrane 1210 as will be explained shortly. The water is distributed to each of the even channels labeled "A" in the figure. The water exits the channels labeled "A" through a manifold 1203 and is collected in drain line 1204. At the same time concentrated desiccant is introduced at 1205, which is distributed through header 1206 to each of the channels labeled "B" in the figure. The concentrated desiccant 1209 flows along the B channels. The wall between the "A" and the "B: channels comprises a selective membrane 1210 which is selective to water so that water molecules can come through the membrane but ions or other materials cannot. This thus prevents for example Lithium and Chloride ions from crossing the membrane into the water "A" channel and vice versa prevents Sodium and Chloride ions from seawater crossing into the desiccant in the "B" channel. Since the concentration of Lithium Chloride in the desiccant is typically 25-35%, this provides a strong driving force for the diffusion of water from the "A" to the "B" channel since the concentration of for example Sodium Chloride in sea water is typically less than 3%. Selective membranes of this type are commonly found in membrane distillation or reverse osmosis processes and are well known in the art. The structure of FIG. 12 can be executed in many form factors such as a flat plate structure or a concentric stack of channels or any other convenient form factor. It is also possible to construct the plate structure of FIG. 3 by replacing the wall 255 with a selective membrane as is shown in FIG. 12. However, such a structure would only make sense if one wants to continuously add water to the desiccant. It would make little sense in summer mode when one is trying to remove water from the desiccant. It is therefore easier to implement the structure of FIG. 12 in a separate module as is shown in FIG. 7 and FIG. 13 which can be bypassed in a summer cooling mode. Although in some instances adding water to the desiccant in summer cooling mode may also make sense for example if the outdoor temperature is very hot but also very dry as in a desert. The membrane may be a microporous hydrophobic structure comprising a polypropylene, a polyethylene, or an ECTFE (Ethylene ChloroTriFluoroEthylene) membrane.

FIG. 13 illustrates how the water injection system from FIG. 12 can be integrated to the desiccant pumping subsystem of FIG. 7. The desiccant pump 732 pumps desiccant through the water injection module 1301 and through the heat exchanger 733 as was shown in FIG. 7. The desiccant returns from the conditioner (702 in FIG. 7) through line 735 and through the heat exchanger 733 back to the regenerator (712 in FIG. 7). A water reservoir 1304 is filled with water 1305 or a water containing liquid. A pump 1302 pumps the water to the water injection system 1301, where it enters through port 1201 (as shown in FIG. 12). The water flows through the "A" channels in FIG. 12 and exits through port 1204 after which is drains back to the tank 1303. The water injection system 1301 is sized in such a way that the diffusion of water through the selective membranes 1210 is matched to the amount of water that would have to be added to the desiccant. The water injection system can comprise several independent sections that are individually switchable so that water could be added to the desiccant in several stages.

The water 1304 flowing through the injection module 1301 is partially transmitted through the selective membranes 1210. Any excess water exits through the drain line 1204 and falls back in the tank 1303. As the water is pumped from the tank 1304 again by pump 1302, less and less water will return to the tank. A float switch 1307 such as is commonly used on cooling towers can be used to maintain a proper water level in the tank. When the float switch detects a low water level, it opens valve 1308 which lets additional water in from supply water line 1306. However, since the selective membrane only pass pure water through, any residuals such as Calcium Carbonates, or other non-passible materials will collect in the tank 1303. A blow-down valve 1305 can be opened to get rid of these unwanted deposits as is commonly done on cooling towers.

It should be clear to those skilled in the art that the water injection system of FIG. 12 can be used in other liquid desiccant system architectures for example in those described in Ser. No. 13/115,686, US 2012/0125031 A1, Ser. No. 13/115,776, and US 2012/0125021 A1.

Figure 14:
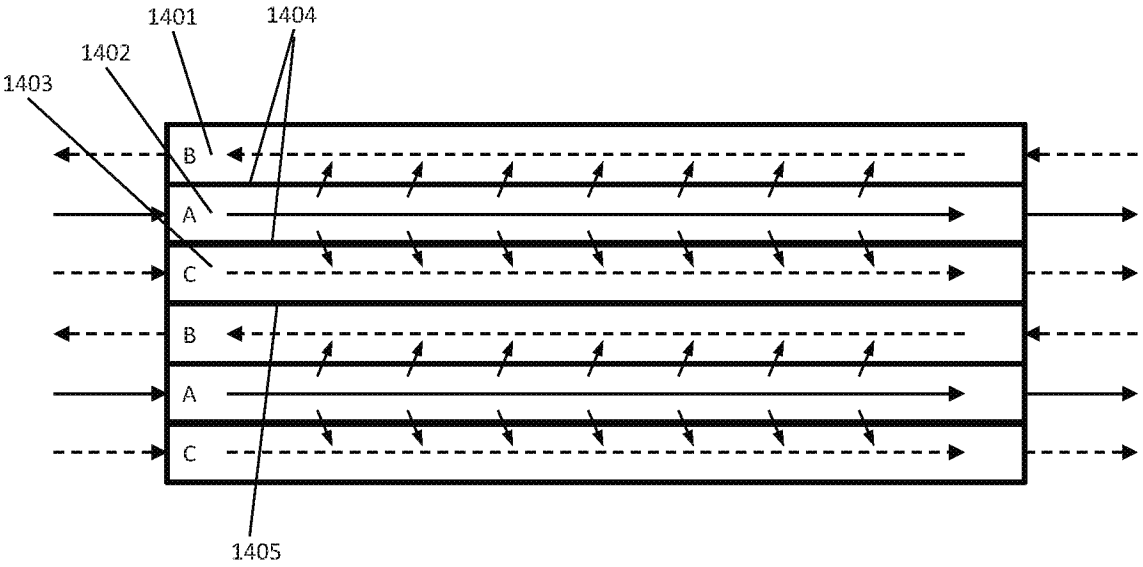
FIG. 14 illustrates two sets of channel triplets that simultaneously provide a heat exchange and desiccant humidification function.

FIG. 14 illustrates how the water injection system from FIG. 12 and FIG. 13 can be integrated to the desiccant to desiccant heat exchanger 733 from FIG. 13. The water flows through the "A" channels 1402 in FIG. 14 and exits through a port after which is drains back to the tank as described in FIG. 13. A cold desiccant is introduced in the "B" channels 1401 in FIG. 14 and a warm desiccant is introduced in the "C" channels in FIG. 14. The walls 1404 between the "A" and "B" and "A" and "C" channels respectively are again constructed with a selectively permeable membrane. The wall 1405 between the "B" and the "C" channel is a non-permeable membrane such as a plastic sheet which can conduct heat but not water molecules. The structure of FIG. 14 thus accomplishes two tasks simultaneously: it provides a heat exchange function between the hot and the cold desiccant and it transmit water from the water channel to the two desiccant channels in each channel triplet.

Figure 15:
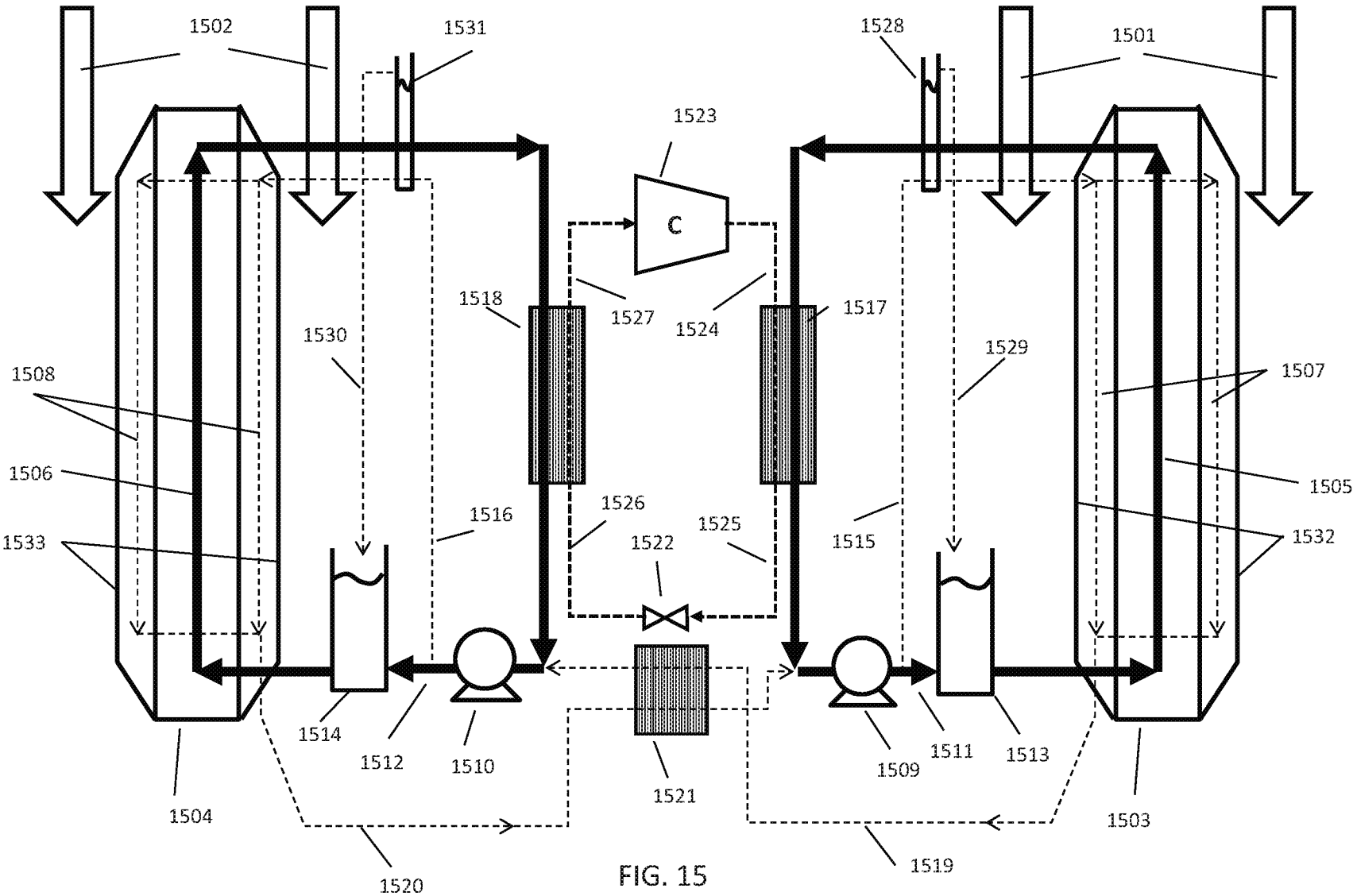
FIG. 15 shows two of the 3-way membrane modules of FIG. 3 integrated into a DOAS, wherein the heat transfer fluid and the liquid desiccant fluid have been combined into a single desiccant fluid system, while retaining the advantage of separate paths for the fluid that is performing the dehumidification function and the fluid that is doing the heat transfer function.

FIG. 15 illustrates an embodiment wherein two of the membrane modules of FIG. 3 have been integrated into a DOAS but wherein the heat transfer fluid and the desiccant that were two separate fluids in FIGS. 1, 2 and 3 (the desiccant—labeled 114 and 115 in FIG. 1—is typically a lithium chloride/water solution and the heat transfer fluid—labeled 110 in FIG. 1 is typically water or a water/glycol mixture) are combined in a single fluid (which would typically be lithium chloride and water, but any suitable liquid desiccant will do). By using a single fluid the pumping system can be simplified because the desiccant pump (for example 632 in FIG. 6), can be eliminated. However, it is desirable to still maintain a counter-flow arrangement between the air stream 1501 and/or 1502 and the heat transfer path 1505 and/or 1506. In two-way membrane modules the desiccant is oftentimes not able to maintain a counter-flow path to the air stream, since the desiccant generally moves vertical with gravity and the air stream often is desired to be horizontal resulting in a cross-flow arrangement. As described in application 61/951,887 (for example in FIG. 400 and FIG. 900), in a 3-way membrane module, it is possible to create a counter-flow between the air stream and a heat transfer fluid stream, while a small desiccant stream (typically 5-10% of the mass flow of the heat transfer fluid stream) is mostly absorbing or desorbing the latent energy from or to the air stream. By using the same fluid for the latent absorption and the heat transfer but having separate paths for each, one can obtain a much better efficiency of the membrane module since the primary air and heat transfer fluid flows are arranged in a counter-flow arrangement, and the small desiccant stream that is absorbing or desorbing the latent energy may still be in a cross-flow arrangement, but because the mass flow rate of the small desiccant stream is small, the effect on efficiency is negligible.

Specifically, in FIG. 15, an air stream 1501 which can be outside air, or return air from a space or a mixture between the two, is directed over a membrane structure 1503. The membrane structure 1503 is the same structure from FIG. 3. However, the membrane structure (only a single plate structure is shown although generally multiple plate structures would be used in parallel) is now supplied by pump 1509 with a large desiccant stream 1511 through tank 1513. This large desiccant stream runs in the heat transfer channel 1505 counter to the air stream 1501. A smaller desiccant stream 1515 is also simultaneously pumped by the pump 1509 to the top of the membrane plate structures 1503 where it flows by gravity behind the membranes 1532 in flow channel 1507. The flow channel 1507 is generally vertical; however the heat transfer channel 1505 can be either vertical or horizontal, depending on whether the air stream 1501 is vertical or horizontal. The desiccant exiting the heat transfer channel 1505 is now directed to a condenser heat exchanger 1517, which, because of the corrosive nature of most liquid desiccants such as lithium chloride, is usually made from Titanium or some other non-corrosive material. To prevent excessive pressure behind the membranes 1532, an overflow device 1528 can be employed that results in excess desiccant being drained through tube 1529 back to the tank 1513. Desiccant that has desorbed latent energy into the air stream 1501 is now directed through drain line 1519 through heat exchanger 1521 to pump 1508.

The heat exchanger 1517 is part of a heat pump comprising compressor 1523, hot gas line 1524, liquid line 1525, expansion valve 1522, cold liquid line 1526, evaporator heat exchanger 1518 and gas line 1527 which directs a refrigerant back to the compressor 1523. The heat pump assembly can be reversible as described earlier for allowing switching between a summer operation mode and a winter operation mode.

Further, in FIG. 15, a second air stream 1502 which can also be outside air, or return air from a space or a mixture between the two, is directed over a second membrane structure 1504. The membrane structure 1504 is the same structure from FIG. 3. However, the membrane structure (only a single plate structure is shown although generally multiple plate structures would be used in parallel) is now supplied by pump 1510 with a large desiccant stream 1512 through tank 1514. This large desiccant stream runs in heat transfer channel 1506 counter to the air stream 1502. A smaller desiccant stream 1516 is also pumped by the pump 1510 to the top of the membrane plate structures 1504 where it flows by gravity behind the membranes 1533 in flow channel 1508. The flow channel 1508 is generally vertical; however the heat transfer channel 1506 can be either vertical or horizontal, depending on whether the air stream 1502 is vertical or horizontal. The desiccant exiting the heat transfer channel 1506 is now directed to a evaporator heat exchanger 1518, which, because of the corrosive nature of most liquid desiccants such as lithium chloride, is usually made from Titanium or some other non-corrosive material. To prevent excessive pressure behind the membranes 1533, an overflow device 1531 can be employed that results in excess desiccant being drained through tube 1530 back to the tank 1514. Desiccant that has absorbed latent energy from the air stream 1502 is now directed through drain line 1520 through heat exchanger 1521 to pump 1509.

The structure described above has several advantages in that the pressure on the membranes 1532 and 1533 is very low and can even be negative essentially syphoning the desiccant through the channels 1507 and 1508. This makes the membrane structure significantly more reliable since the pressure on the membranes will be minimized or even be negative resulting in performance similar to that described in application Ser. No. 13/915,199. Furthermore, since the main desiccant streams 1505 and 1506 are counter to the air flow 1501 and 1502 respectively, the effectiveness of the membrane plate structures 1503 and 1504 is much higher than a cross-flow arrangement would be able to achieve.

Figure 16:
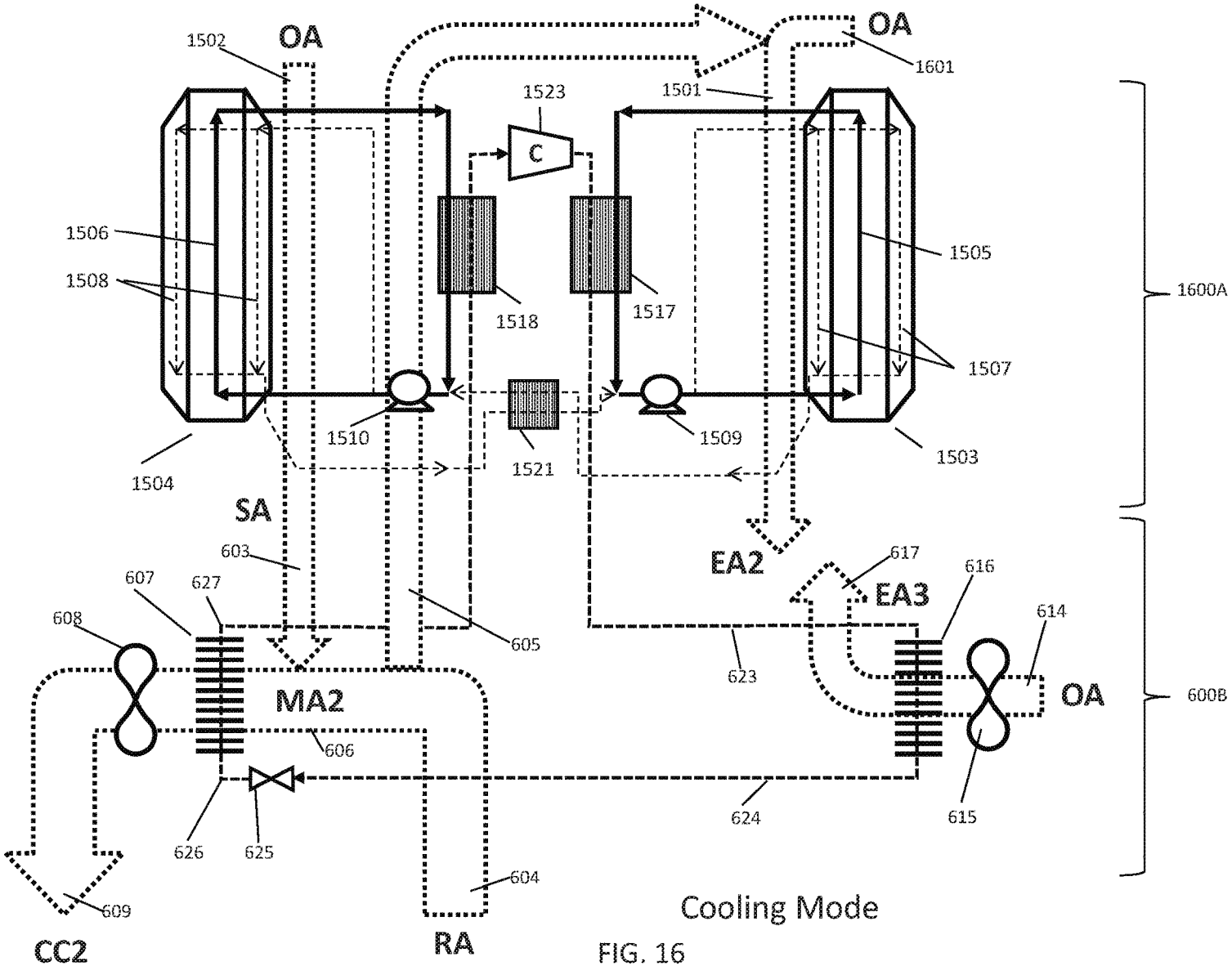
FIG. 16 shows the system of FIG. 15 integrated to the system of FIG. 6.

FIG. 16 illustrates how the system from FIG. 15 can be integrated to the system in FIG. 6 (or FIG. 7 for winter mode). The major components from FIG. 15 are labeled in the figure as are the components from FIG. 6. As can be seen in the figure, the system 1600A is added as an outside air treatment system where the outside air OA (1502) is directed over the conditioner membrane plates 1504. As before, the main desiccant stream 1506 is pumped by pump 1510 in counter-flow to the air stream 1502 and the small desiccant stream 1508 is carrying off the latent energy from the air stream 1502. The small desiccant stream is directed through heat exchanger 1521 to pump 1509 where it is pumped through regenerator membrane plate structure 1503. The main desiccant stream 1505 is again counter to the air stream 1501, which comprises an outside air stream 1601 mixed with a return air stream 605. A small desiccant stream 1507 is now used to desorb moisture from the desiccant. As before in FIG. 6, the system of FIG. 16 is reversible by reversing the direction of the heat pump system comprising compressor 1523, heat exchangers 1517 and 1518, and coils 616 and 607 as well as expansion valve 625.

It should also be clear from FIG. 16 that a conventional two-way liquid desiccant module could be employed in lieu of modules 1503 and 1504. Such a two-way liquid desiccant module could have a membrane or could have no membrane and are well known in the art.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only, and are not intended to be limiting.

What is claimed is:

1. An air conditioning system operable in a cooling operation mode or in a heating operation mode, or selectably operable in either of said modes, said air conditioning system cooling and dehumidifying a space in a building when operating in the cooling operation mode, and heating and humidifying the space when operating in the heating operation mode, the system comprising:

a first coil acting as a refrigerant evaporator for evaporating a refrigerant flowing therethrough and cooling a first air stream to be provided to the space in the building in the cooling operation mode, or for acting as a refrigerant condenser for condensing the refrigerant flowing therethrough and heating the first air stream to be provided to the space in the building in the heating operation mode, said first air stream comprising a return air stream from the space combined with a treated outside air stream;

a refrigerant compressor in fluid communication with the first coil for receiving the refrigerant from the first coil and compressing the refrigerant in the cooling operation mode, or for compressing the refrigerant to be provided to the first coil in the heating operation mode;

a second coil in fluid communication with the refrigerant compressor and acting as a refrigerant condenser for condensing the refrigerant received from the refrigerant compressor and heating an outside air stream to be exhausted in the cooling operation mode, or for acting as a refrigerant evaporator for evaporating the refrigerant to be provided to the refrigerant compressor and cooling an outside air stream to be exhausted in the heating operation mode;

an expansion valve in fluid communication with the first coil and with the second coil for expanding and cooling the refrigerant received from the second coil to be provided to the first coil in the cooling operation mode, or for expanding and cooling the refrigerant received from the first coil to be provided to the second coil in the heating operation mode;

a liquid desiccant conditioner including a plurality of structures, each of the structures having at least one surface across which a liquid desiccant flows and an internal passage in fluid communication with the first coil and the refrigerant compressor such that the refrigerant flowing between the first coil and the refrigerant compressor flows through said internal passage, wherein the liquid desiccant conditioner cools and dehumidifies an outside air stream flowing between the structures in the cooling operation mode, or heats and humidifies an outside air stream flowing between the structures in the heating operation mode, said outside air stream so treated by the liquid desiccant conditioner to be combined with the return air stream from the space in the building to form the first air stream to be cooled or heated by the first coil; and a liquid desiccant regenerator in fluid communication with the liquid desiccant conditioner for receiving the liquid desiccant used in the liquid desiccant conditioner, concentrating the liquid desiccant in the cooling operation mode or diluting the liquid desiccant in the heating operation mode, and then returning the liquid desiccant to the conditioner, said liquid desiccant regenerator including a plurality of structures, each of the structures having at least one surface across which the liquid desiccant flows and an internal passage in fluid communication with the second coil and the refrigerant compressor such that refrigerant flowing between the second coil and the refrigerant compressor flows through said internal passage, wherein the liquid desiccant humidifies and heats the outside air stream to be exhausted in the cooling operation mode or dehumidifies and cools the outside air stream to be exhausted in the heating operation mode.

2. The air conditioning system of claim 1, wherein the plurality of structures in the liquid desiccant conditioner and the plurality of structures in the liquid desiccant regenerator are arranged in a substantially vertical orientation.

3. The air conditioning system of claim 1, wherein the plurality of structures in the liquid desiccant conditioner and the plurality of structures in the liquid desiccant regenerator are parallel to each other.

4. The air conditioning system of claim 1, wherein the plurality of structures in the liquid desiccant conditioner and the plurality of structures in the liquid desiccant regenerator are tubular and arranged concentrically.

5. The air conditioning system of claim 1, wherein each of the structures in the liquid desiccant conditioner and each of the structures in the liquid desiccant regenerator further includes a separate desiccant collector at a lower end of the at least one surface for collecting the liquid desiccant that has flowed across the at least one surface of the structures, said desiccant collectors being spaced apart from each other to permit airflow therebetween.

6. The air-conditioning system of claim 1, wherein the air stream flowing between the structures in the liquid desiccant regenerator comprises an outside air stream, a portion of the return air stream from the space in the building, or a mixture of both.

7. The air conditioning system of claim 1, wherein each of said structures in the liquid desiccant conditioner and the liquid desiccant regenerator includes a sheet of material positioned proximate to the at least one surface of each structure between the liquid desiccant and the air stream, said sheet of material guiding the liquid desiccant into a desiccant collector and permitting transfer of water vapor between the liquid desiccant to the air stream.

8. The air conditioning system of claim 7, wherein the sheet of material comprises a membrane.

9. The air conditioning system of claim 7, wherein the sheet of material comprises a hydrophilic material.

10. The air conditioning system of claim 7, wherein the sheet of material comprises a flocking material.

11. The air conditioning system of claim 7, wherein each structure includes two opposite surfaces across which the liquid desiccant flows, and wherein a sheet of material covers or retains the liquid desiccant on each opposite surface.

12. The air conditioning system of claim 1, further comprising a water injection system for adding water to the liquid desiccant used in the liquid desiccant conditioner.

13. The air conditioning system of claim 12, wherein the water injection system comprises:

an enclosure having one or more selectively permeable microporous hydrophobic structures defining alternate channels on opposite sides of each structure for flow of the water or the liquid containing primarily water in one channel and for flow of the liquid desiccant separately in an adjacent channel, wherein each structure enables selective diffusion through the structure of water molecules from the water or the liquid containing primarily water to the liquid desiccant;

a water inlet port and a water outlet port in the enclosure in fluid communication with each channel through which the water or liquid containing primarily water flows; and a liquid desiccant inlet port and a liquid desiccant output port in the enclosure in fluid communication with each channel through which the liquid desiccant flows, wherein the liquid desiccant inlet port receives the liquid desiccant from the liquid desiccant regenerator, and the liquid desiccant outlet port provides the liquid desiccant to the liquid desiccant conditioner, or wherein the liquid desiccant inlet port receives the liquid desiccant from the liquid desiccant conditioner, and the liquid desiccant outlet port provides the liquid desiccant to the liquid desiccant regenerator.

14. The air conditioning system of claim 12, wherein the flow or refrigerant through the first coil, the refrigerant compressor, the second coil, and the expansion valve is reversed in order to change between the cooling operation mode and the heating operation mode.

15. A method of cooling and dehumidifying a space in a building using a liquid desiccant air conditioning system operating in a cooling operation mode, the method comprising:

(a) circulating refrigerant in a refrigerant circuit including a first coil acting as a refrigerant evaporator for evaporating the refrigerant flowing therethrough, a refrigerant compressor in fluid communication with the first coil for receiving the refrigerant from the first coil and compressing the refrigerant, a second coil in fluid communication with the refrigerant compressor and acting as a refrigerant condenser for condensing the refrigerant received from the refrigerant compressor and heating an outside air stream to be exhausted, and an expansion valve in fluid communication with the first coil and with the second coil for expanding and cooling the refrigerant received from the second coil to be provided to the first coil;

(b) cooling and dehumidifying an outside air stream in a liquid desiccant conditioner, wherein the outside air stream is dehumidified using a liquid desiccant, and wherein the refrigerant flowing between the first coil and the refrigerant compressor flows through the liquid desiccant conditioner to cool the outside air stream;

(c) combining the air stream treated by the conditioner in (b) with a return air stream from the space;

(d) cooling the combined air stream in (c) using the first coil, and providing the air stream cooled by the first coil to the space in the building; and (e) concentrating the liquid desiccant used in the liquid desiccant conditioner in a liquid desiccant regenerator, and returning the concentrated liquid desiccant to the liquid desiccant conditioner, wherein the refrigerant flowing between the refrigerant compressor and the second coil flows through said liquid desiccant regenerator.

16. The method of claim 15, further comprising switching operation of the liquid desiccant air conditioning system to a heating operation mode to heat and humidify the space by reversing flow of the refrigerant in the refrigerant circuit.

17. The method of claim 16, wherein in the heating operation mode: the first coil acts as a refrigerant condenser for condensing the refrigerant flowing therethrough and heating a first air stream to be provided to the space in the building; the refrigerant compressor compresses the refrigerant to be provided to the first coil; the second coil acts as a refrigerant evaporator for evaporating the refrigerant to be provided to the refrigerant compressor and cooling an outside air stream to be exhausted; the expansion valve expands and cools the refrigerant received from the first coil to be provided to the second coil; the liquid desiccant conditioner heats and humidifies the outside air stream to be combined with the return air stream to be heated by the first coil; and the liquid desiccant regenerator dilutes the liquid desiccant used in the liquid desiccant conditioner and then returns the liquid desiccant to the conditioner.

18. The method of claim 15, further comprising adding water to the liquid desiccant used in the liquid desiccant conditioner.

19. A method of heating and humidifying a space in a building using a liquid desiccant air conditioning system operating in a heating operation mode, the method comprising:

(a) circulating refrigerant in a refrigerant circuit including a first coil acting as a refrigerant condenser for condensing the refrigerant flowing therethrough, a refrigerant compressor compressing the refrigerant provided to the first coil, a second coil acting as a refrigerant evaporator for evaporating the refrigerant to be provided to the refrigerant compressor and cooling an outside air stream to be exhausted, and an expansion valve in fluid communication with the first coil and with the second coil for expanding and cooling the refrigerant received from the first coil to be provided to the second coil;

(b) heating and humidifying an outside air stream in a liquid desiccant conditioner, wherein the outside air stream is humidified using a liquid desiccant, and wherein the refrigerant flowing between the refrigerant compressor and the first coil flows through the liquid desiccant conditioner to heat the outside air stream;

(c) combining the air stream treated by the conditioner in (b) with a return air stream from the space;

(d) heating the combined air stream in (c) using the first coil, and providing the air stream heated by the first coil to the space in the building; and (e) diluting the liquid desiccant used in the liquid desiccant conditioner in a liquid desiccant regenerator, and returning the diluted liquid desiccant to the liquid desiccant conditioner, wherein the refrigerant flowing between the refrigerant compressor and the second coil flows through said liquid desiccant regenerator.

20. The method of claim 19, further comprising switching operation of the liquid desiccant air conditioning system to a cooling operation mode to cool and dehumidify the space by reversing flow of the refrigerant in the refrigerant circuit.

21. The method of claim 19, further comprising adding water to the liquid desiccant used in the liquid desiccant conditioner.

* * * * *